US012741180B2

(12) United States Patent
Kleinert

(10) Patent No.: US 12,741,180 B2
(45) Date of Patent: Sep. 22, 2026

(54) GOLF CLUB HEAD

(71) Applicant: Taylor Made Golf Company, Inc., Carlsbad, CA (US)

(72) Inventor: Justin David Kleinert, San Clemente, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 341 days.

(21) Appl. No.: 18/392,238

(22) Filed: Dec. 21, 2023

(65) Prior Publication Data

US 2024/0207697 A1 Jun. 27, 2024

Related U.S. Application Data

(60) Provisional application No. 63/434,910, filed on Dec. 22, 2022.

(51) Int. Cl.
*A63B 53/06* (2015.01)
*A63B 53/04* (2015.01)

(52) U.S. Cl.
CPC ..... *A63B 53/0466* (2013.01); *A63B 53/0412* (2020.08); *A63B 2209/00* (2013.01)

(58) Field of Classification Search
CPC ..... A63B 53/0466
IPC ..... A63B 53/0466,53/0412
See application file for complete search history.

(56) References Cited

U.S. PATENT DOCUMENTS

| | | | | |
|---|---|---|---|---|
| 7,407,447 | B2 | 8/2008 | Beach et al. | |
| 7,419,441 | B2 | 9/2008 | Hoffman et al. | |
| 9,174,099 | B2 | 11/2015 | Greaney et al. | |
| 9,975,011 | B1 * | 5/2018 | Wester | A63B 60/52 |
| 2018/0185719 | A1 * | 7/2018 | Johnson | A63B 53/06 |
| 2021/0146203 | A1 * | 5/2021 | Greaney | A63B 53/0466 |
| 2021/0387064 | A1 * | 12/2021 | Nielson | A63B 60/02 |

* cited by examiner

*Primary Examiner* — Raeann Gorden
(74) *Attorney, Agent, or Firm* — Klarquist Sparkman, LLP

(57) ABSTRACT

A golf club head is described having a heel portion, a sole portion, a toe portion, a crown portion, a front portion, a rear portion, and a striking face, the front portion having an upper front portion and a lower front portion. In certain examples, the upper front portion is described as made of a first material and the lower front portion made of a material different from the upper front portion. In particular examples, an aft body is described having at least a portion of the crown portion and a portion of the sole portion, the aft body being made of a non-metallic and metallic material. In further particular examples, the golf club head is described as having a D1z ratio of between 0.5 (kg $mm^3$)/$cm^3$ and 6.2 (kg·$mm^3$)/$cm^3$.

20 Claims, 16 Drawing Sheets

GOLF CLUB HEAD

CROSS REFERENCE TO RELATED APPLICATION

This application claims the benefit of U.S. Provisional Application No. 63/434,910, which was filed on Dec. 22, 2022, and is incorporated herein by reference in its entirety.

FIELD

The present disclosure relates to a golf club head. More specifically, the present disclosure relates to a golf club head having unique head properties.

BACKGROUND

A golf set includes various types of clubs for use in different conditions or circumstances in which a ball is hit during a golf game. A set of clubs typically includes a "driver" for hitting the ball the longest distance on a course. A fairway "wood" can be used for hitting the ball shorter distances than the driver. A set of irons are used for hitting the ball within a range of distances typically shorter than the driver or woods.

SUMMARY OF THE DESCRIPTION

The present disclosure describes a golf club head comprising a heel portion, a toe portion, a crown, a sole, and a face.

The foregoing and other objects, features, and advantages of the invention will become more apparent from the following detailed description, which proceeds with reference to the accompanying figures.

According to one aspect of an embodiment of the present invention, a golf club with a unique CG location as far forward as possible is described.

In a particular embodiment disclosed herein, the golf club head includes a heel portion, a sole portion, a toe portion, a crown portion, a front portion, a rear portion, and a striking face. The front portion of this example golf club head has an upper front portion and a lower front portion. The upper front portion is made of a first material and the lower front portion is made of a material different from the upper front portion. The golf club head includes an aft body having at least a portion of the crown portion and a portion of the sole portion. The aft body is made of a non-metallic and metallic material. The golf club head has a D1z ratio of between 0.5 $(kg \cdot mm^3)/cm^3$ and 6.2 $(kg \cdot mm^3)/cm^3$. The golf club head also has a CGX of between 0 mm and 4 mm. The golf club head further has a CGZ of between 0 mm and −11 mm. The golf club head further has a CGY of between 15 mm and 23 mm. The golf club head further has a Delta1 of between 1 mm and 10 mm. The golf club head further has a Delta2 of between 25 mm and 35 mm. The golf club head further has a Delta3 of between 65 mm and 80 mm. The golf club head further has a CFY of between 12 mm and 17 mm. The golf club head further has a mass between 190 g and 215 g. The golf club head further has an Ixx of between 100 $kg \cdot mm^2$ and 200 $kg \cdot mm^2$. The golf club head further has an Iyy of between 200 $kg \cdot mm^2$ and 275 $kg \cdot mm^2$. The golf club head further has an Izz of between 230 $kg \cdot mm^2$ and 320 $kg \cdot mm^2$. The golf club head further has a BP Proj. Up of between 15 mm and 30 mm. The golf club head further has a Zup of between 10 mm and 25 mm. The golf club head further has a volume divided by Delta1 ratio of between 50 cc/mm to 230 cc/mm. The golf club head further has a volume divided by Zup ratio of between 10 cc/mm and 30 cc/mm. The golf club head further has a Zup divided by D1 ratio of between 2 to 15. The golf club head further has a volume divided by Zup divided by D1 ratio of between 20 cc and 170 cc. The golf club head further has a D1y ratio of between 0.5 $(kg \cdot mm^3)/cm^3$ and 5.0 $(kg \cdot mm^3)/cm^3$. The golf club head further has a D1x ratio of between 0.3 $(kg \cdot mm^3)/cm^3$ and 3.9 $(kg \cdot mm^3)/cm^3$. The golf club head further has a D1xz ratio of between 100 $(kg^2 \cdot mm^5)/cm^3$ and 1300 $(kg^2 \cdot mm^5)/cm^3$. The golf club head further has a D1xyz ratio of between 30,000 $(kg^3 \cdot mm^7)/cm^3$ and 280,000 $(kg^3 \cdot mm^7)/cm^3$.

BRIEF DESCRIPTION OF THE DRAWINGS

The present invention is illustrated by way of example and not limitation in the figures of the accompanying drawings in which like references indicate similar elements.

DETAILED DESCRIPTION

Figure 1:
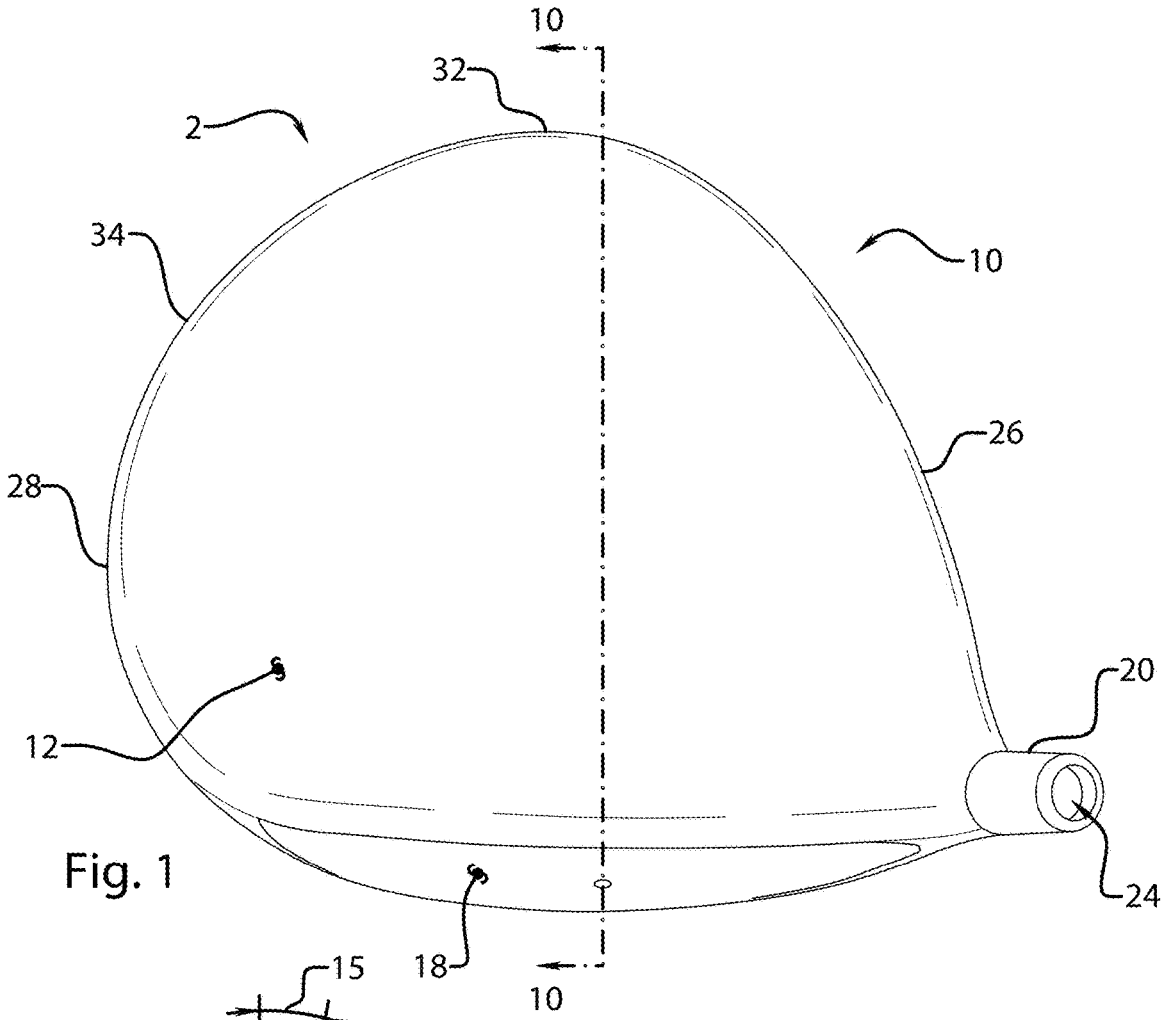
FIG. 1 is a top view of a golf club head according to an embodiment.

The inventive features include all novel and non-obvious features disclosed herein both alone and in novel and non-obvious combinations with other elements. As used herein, the phrase "and/or" means "and", "or" and both "and" and "or". As used herein, the singular forms "a," "an," and "the" refer to one or more than one, unless the context clearly dictates otherwise. As used herein, the term "includes" means "comprises." The preferred embodiments of the invention accomplish the stated objectives by new and novel arrangements of elements and configurations, materials, and methods that are configured in unique and novel ways and which demonstrate previously unavailable but preferred and desirable capabilities. The description set forth below in connection with the drawings is intended merely as a description of the presently preferred embodiments of the invention, and is not intended to represent the only form in which the present invention may be constructed or utilized. The description sets forth the designs, materials, functions, means, and methods of implementing the invention in connection with the illustrated embodiments. It is to be understood, however, that the same or equivalent functions, features, and material properties may be accomplished by different embodiments that are also intended to be encompassed within the spirit and scope of the invention. The present disclosure is described with reference to the accompanying drawings with preferred embodiments illustrated and described. The disclosure may, however, be embodied in many different forms and should not be construed as limited to the embodiments set forth herein; rather, these embodiments are provided so that this disclosure will be thorough and complete, and will fully convey the scope of the disclosure to those skilled in the art. Like numbers refer to like elements throughout the disclosure and the drawings. In the figures, the thickness of certain lines, layers, components, elements or features may be exaggerated for clarity. All publications, patent applications, patents, and other references mentioned herein are incorporated herein by reference in their entireties. Even though the embodiments of this disclosure are particularly suited as golf club heads and golf clubs and reference is made specifically thereto, it should be immediately apparent that embodiments of the present disclosure are applicable to non-club heads as well.

The following disclosure describes embodiments of golf club heads for ultra-low Delta1 metalwood type golf clubs. Several of the golf club heads incorporate features that provide the golf club heads and/or golf clubs with a low Delta1 and/or dimensions and unique relationships providing improved performance associated with club head constructions that provide unique and preferential mass properties for a club head 2, as well as unique dimensional configurations, unique face designs, higher coefficients of restitution ("COR") and characteristic times ("CT"), and/or impart preferred launch conditions upon a golf ball, including, but not limited to, decreased backspin rates, relative to other golf club heads that have come before. The disclosure makes reference to the accompanying drawings which form a part hereof, wherein like numerals designate like parts throughout. The drawings illustrate specific embodiments, but other embodiments may be formed, and structural changes may be made without departing from the intended scope of this disclosure. Directions and references (e.g., up, down, top, bottom, left, right, rearward, forward, heelward, toward, etc.) may be used to facilitate discussion of the drawings but are not intended to be limiting. For example, certain terms may be used such as "up," "down,", "upper," "lower," "horizontal," "vertical," "left," "right," and the like. These terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" surface can become a "lower" surface simply by turning the object over. Nevertheless, it is still the same object. Accordingly, the following detailed description shall not to be construed in a limiting sense and the scope of property rights sought shall be defined by the appended claims and their equivalents.

Normal Address Position

Club heads and many of their physical characteristics disclosed herein will be described using "normal address position" as the club head reference position, unless otherwise indicated.

Figure 2:
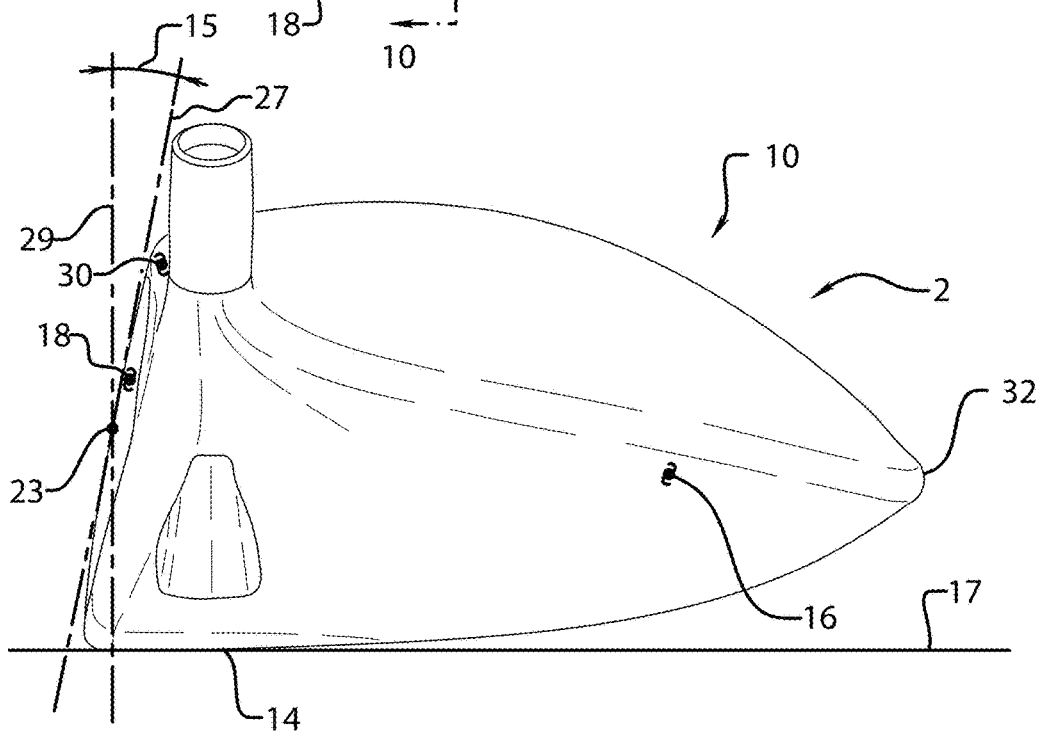
FIG. 2 is a heel sideview of a golf club according to an embodiment.
Figure 3:
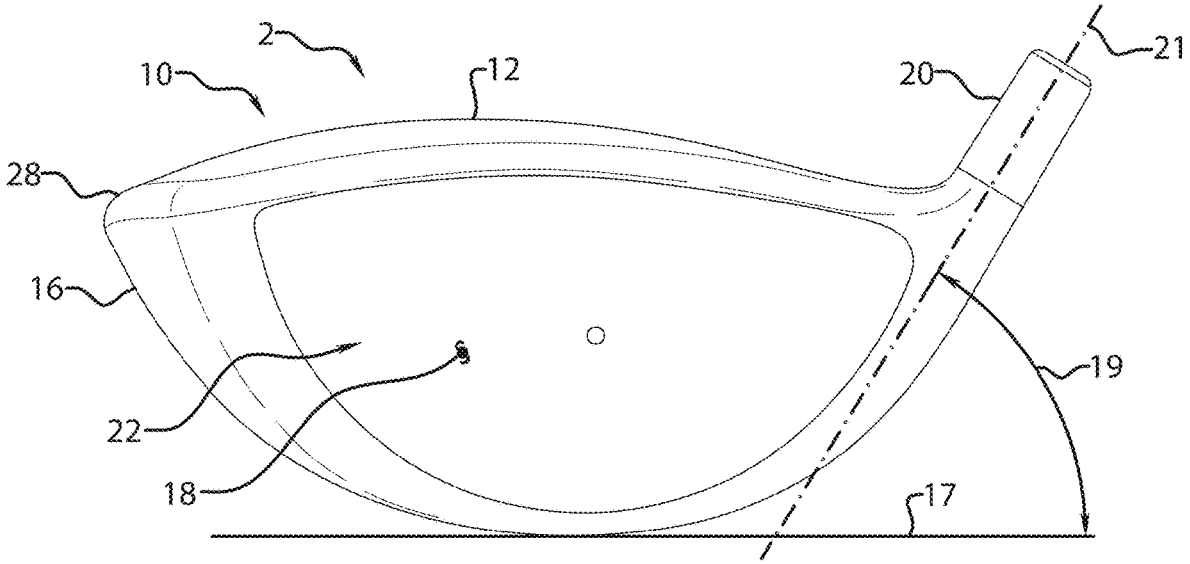
FIG. 3 is a front elevation view of a golf club head according to an embodiment.
Figure 4:
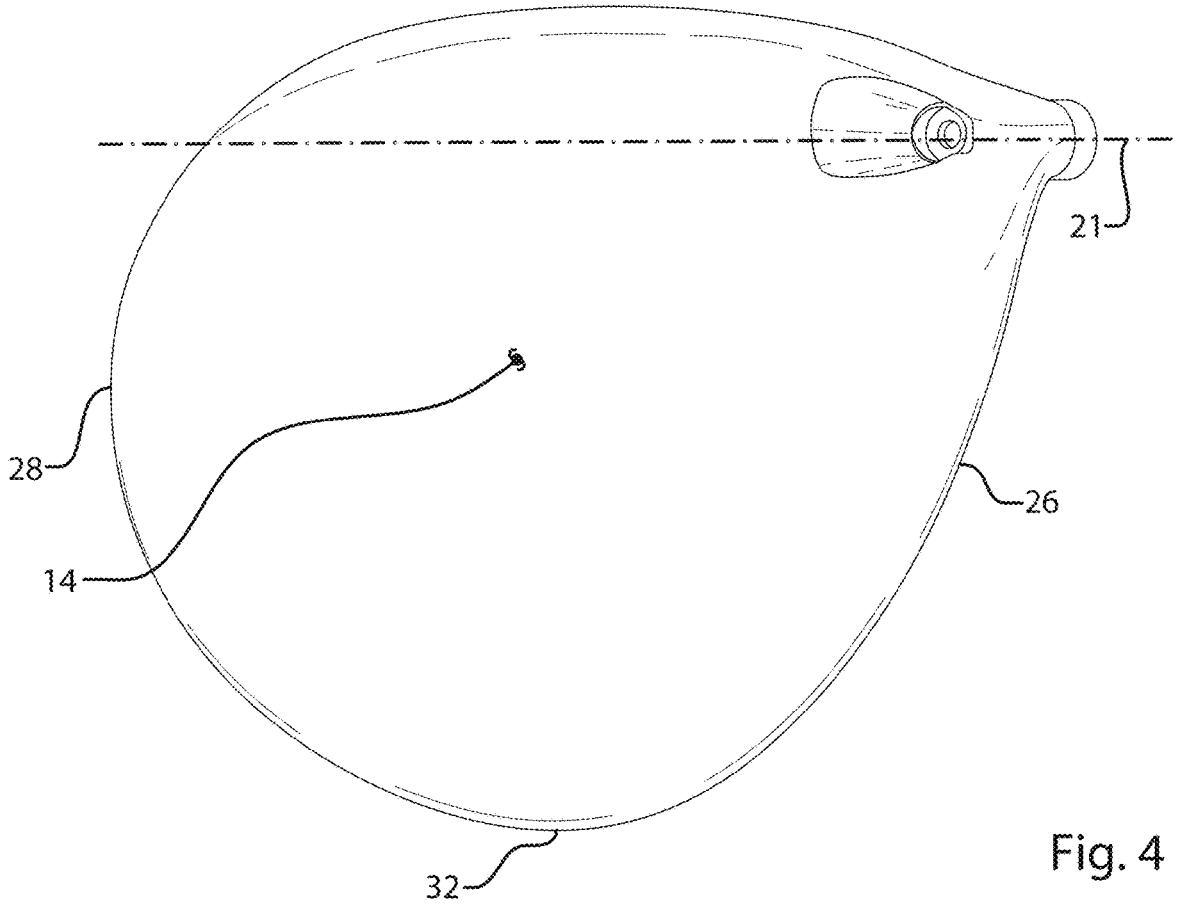
FIG. 4 is a bottom view of a golf club head according to an embodiment.
Figure 5:
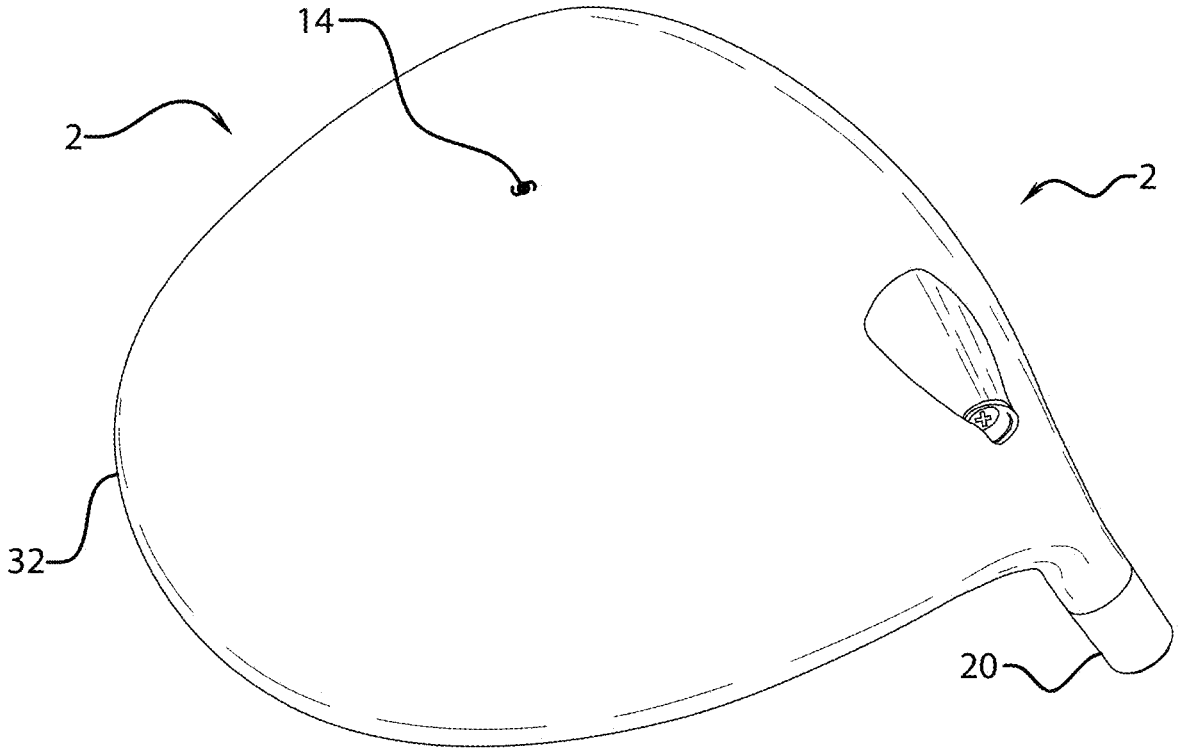
FIG. 5 is an isometric sole view of a golf club head according to an embodiment.
Figure 6:
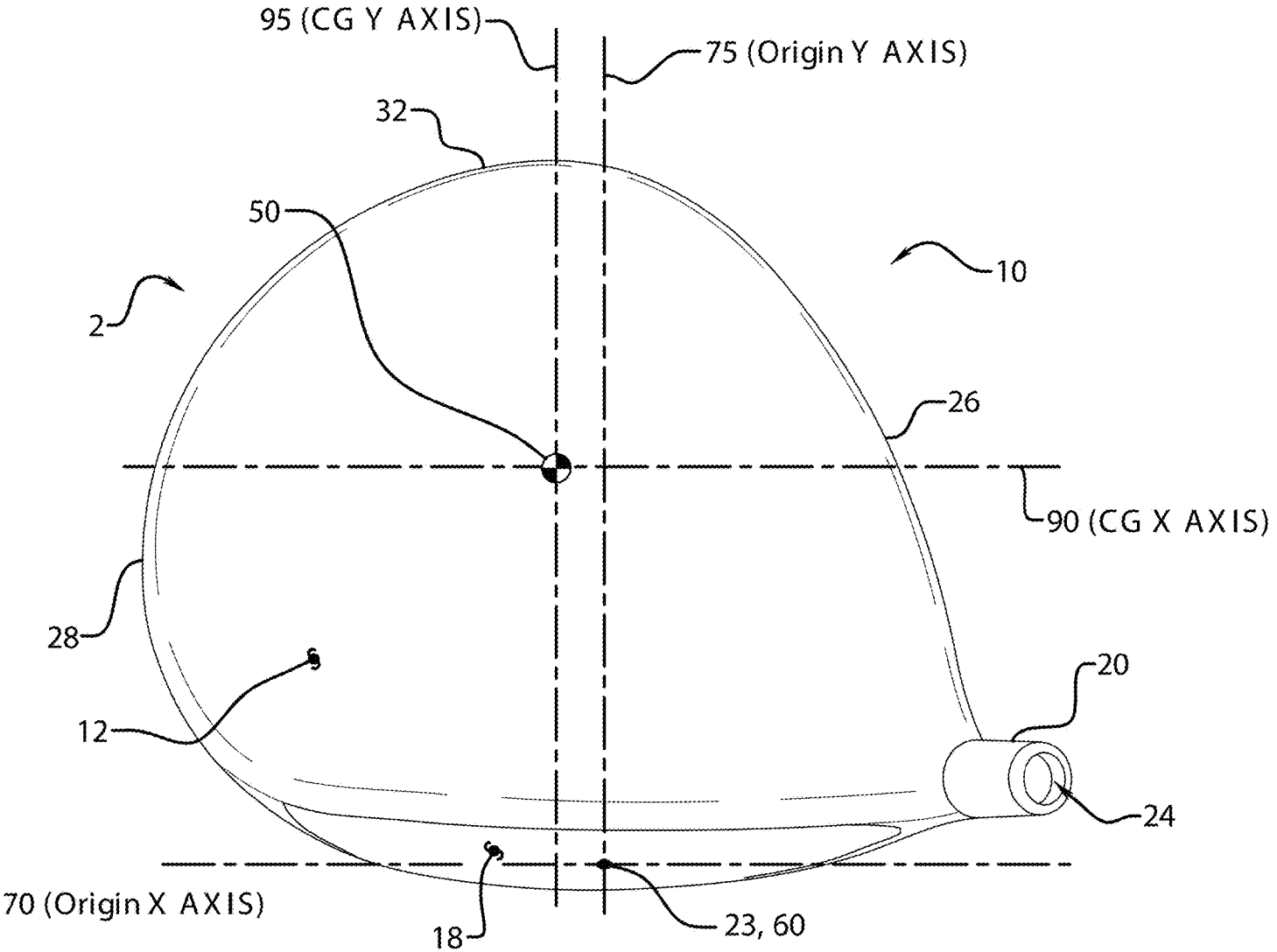
FIG. 6 is top crown view of a golf club head according to an embodiment.

FIGS. 1-4 illustrate one embodiment of a golf club head at normal address position. FIG. 1 illustrates a top plan view of the club head 2, FIG. 2 illustrates a side elevation view from the heel side of the club head 2, FIG. 3 illustrates a front elevation view, and FIG. 4 illustrates a bottom plan view of the club head 2. FIG. 5 is an isometric sole view, and FIG. 6 is a top crown view of the club head 2. By way of preliminary description, the club head 2 includes a hosel 20 and a ball striking club face 18. At normal address position, the club head 2 rests on the ground plane 17, a plane parallel to the ground.

As used herein, "normal address position" means the club head position wherein a vector normal to the club face 18 substantially lies in a first vertical plane (i.e., a vertical plane is perpendicular to the ground plane 17), the centerline axis 21 of the club shaft substantially lies in a second vertical plane, and the first vertical plane and the second vertical plane substantially perpendicularly intersect. In the normal address position, the loft plane 27 is a plane that is tangent to the center of the face is angled to a designated loft angle 15 of the club and the club head 2 is at a 60 degree lie angle.

Club Head Generally

A golf club head, such as the golf club head 2, includes a hollow body 10 defining a crown portion 12, a sole portion 14 and a skirt portion 16. A striking face, or face portion, 18 attaches to the body 10, or may be formed with a portion of the body 10. The body 10 can include a hosel 20, which defines a hosel bore 24 adapted to receive a golf club shaft and/or a shaft sleeve. The body 10 further includes a heel portion 26, a toe portion 28, a front portion 30, and a rear portion 32.

The club head 2 also has a volume, typically measured in cubic-centimeters ($cm^3$), often abbreviated as "cc", equal to the volumetric displacement of the club head 2, assuming any apertures are sealed by a substantially planar surface. (See United States Golf Association "Procedure for Measuring the Club Head Size of Wood Clubs," Revision 1.0, Nov. 21, 2003). In some implementations, the golf club head 2 has a volume between approximately 50 $cm^3$ and approximately 460 $cm^3$, and a total mass between approximately 185 g and approximately 215 g. Additional specific implementations having additional specific values for volume and mass are described elsewhere herein.

As used herein, "crown" means an upper portion of the club head 2 above a peripheral outline 34 of the club head 2 as viewed from a top-down direction and rearward of the topmost portion of the striking face 18, as seen in FIG. 1. As used herein, "sole" means a lower portion of the club head 2 extending upwards from a lowest point of the club head 2 when the club head 2 is at the normal address position. Further, the sole 14 can define a substantially flat portion extending substantially horizontally relative to the ground 17 when in the normal address position. In some implementations, the bottommost portion of the sole 14 extends substantially parallel to the ground 17 between approximately 5% and approximately 70% of the depth Dch of the body 10. In some implementations, an adjustable mechanism is provided on the sole 14 to "decouple" the relationship between face angle and hosel/shaft loft, i.e., to allow for separate adjustment of square loft and face angle of the club head 2. For example, some embodiments of the club head 2 include an adjustable sole portion that can be adjusted relative to the body 10 to raise and lower the rear end of the club head 2 relative to the ground. The club head 2 may include adjustability aspects disclosed in U.S. patent application Ser. No. 14/734,181, which is incorporated herein by reference in its entirety. As used herein, "skirt" means a side portion of the club head 2 between the crown 12 and the sole 14 that extends across the periphery 34 of the club head 2, excluding the face 18, from the toe portion 28, around the rear portion 32, to the heel portion 26.

As used herein, "striking surface" means a front or external surface of the striking face 18 configured to impact a golf ball (not shown). As will be described later in greater detail, in some embodiments the striking face or face portion 18 can be a striking plate attached to the body 10 using techniques, such as welding, and in other embodiments the face portion 18 may include an insert, which may be metallic or non-metallic, and in even further embodiment the face portion 18 is formed integral with a portion of one or more of the crown 12, sole 14, and skirt. Thus, one embodiment incorporates a cup-face construction whereby the face portion 18 is integrally formed, by casting, forging, stamping, or pressing, with a return portion that forms a portion of one or more of the crown 12, sole 14, and skirt. In a further embodiment at least 50% of the perimeter of the face portion 18 has an associated return portion and at least a portion of the return portion extends away from the face portion 18 a return distance that is at least ½ inch, while in another embodiment the return distance is no more than 2 inches. The striking surface 18 may have a bulge and roll curvature, disclosed in great detail later herein.

The body 10 may comprise a polymeric material, a metal alloy (e.g., an alloy of titanium, an alloy of steel, an alloy of aluminum, and/or an alloy of magnesium), a composite material, such as a graphitic composite, a ceramic material, or any combination thereof (e.g., a metallic sole and skirt with a composite, magnesium, or aluminum crown). Embodiments of the club head 2 may include any of the materials and configurations disclosed in U.S. patent application Ser. Nos. 14/717,864, 15/233,805, 15/087,002, and 62/205,601, each of which is incorporated herein in its entirety by reference. In some embodiments the crown 12, sole 14, and skirt 16 may be integrally formed using techniques such as molding, cold forming, casting, and/or forging and the striking face 18 can be attached to the crown 12, sole 14, and skirt 16 by known means, while in other embodiments the striking face 18 is integrally formed with a portion of the crown 12, sole 14, and/or skirt 16. For example, in some embodiments, the body 10 can be formed from a cup-face structure, with a wall or walls extending rearward from the edges of the inner striking face surface and the remainder of the body formed as a separate piece that is joined to the walls of the cup-face by welding, cementing, adhesively bonding, or other technique known to those skilled in the art.

Figure 7:
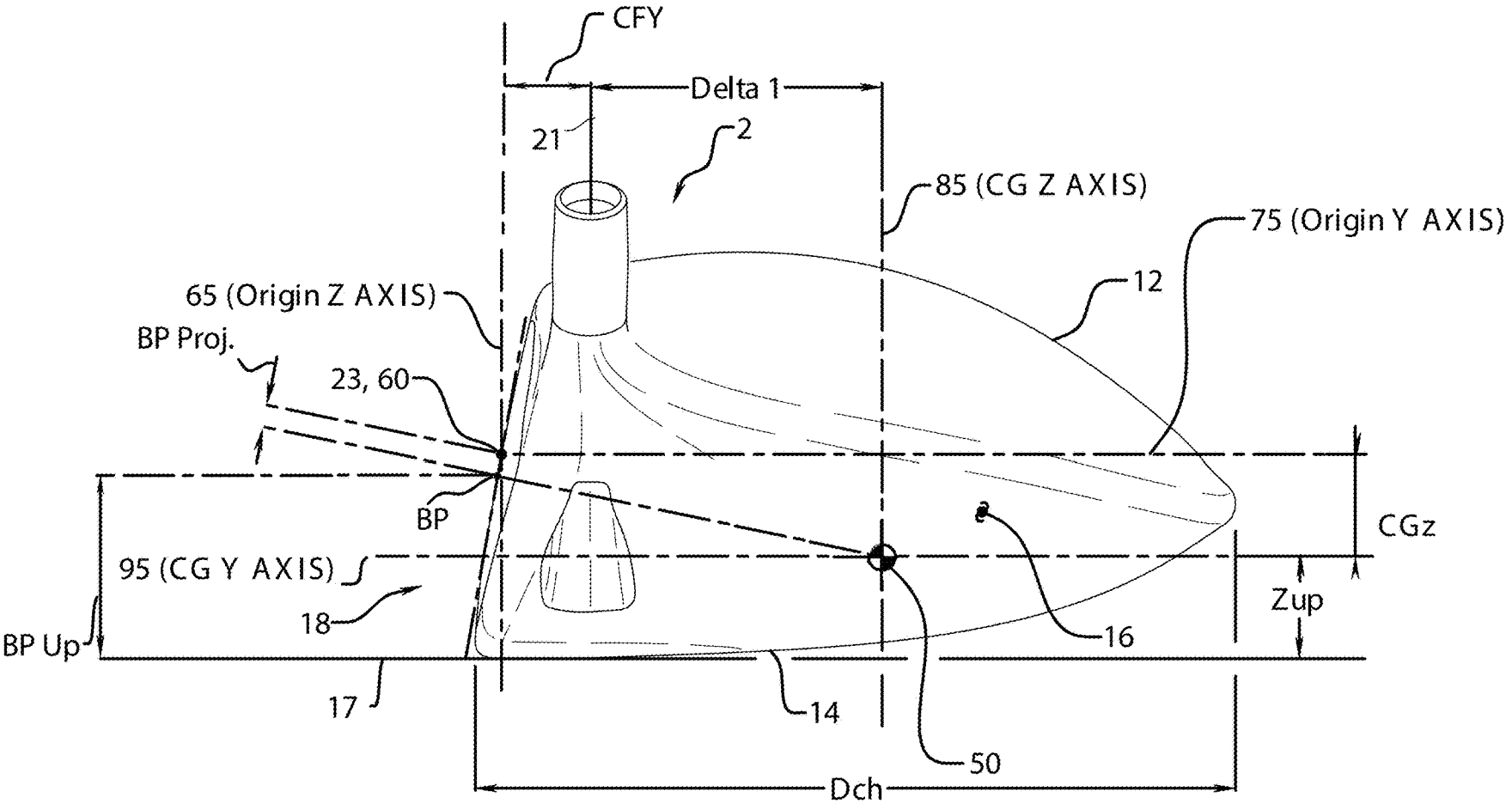
FIG. 7 is heel side view of a golf club head according to an embodiment.
Figure 8:
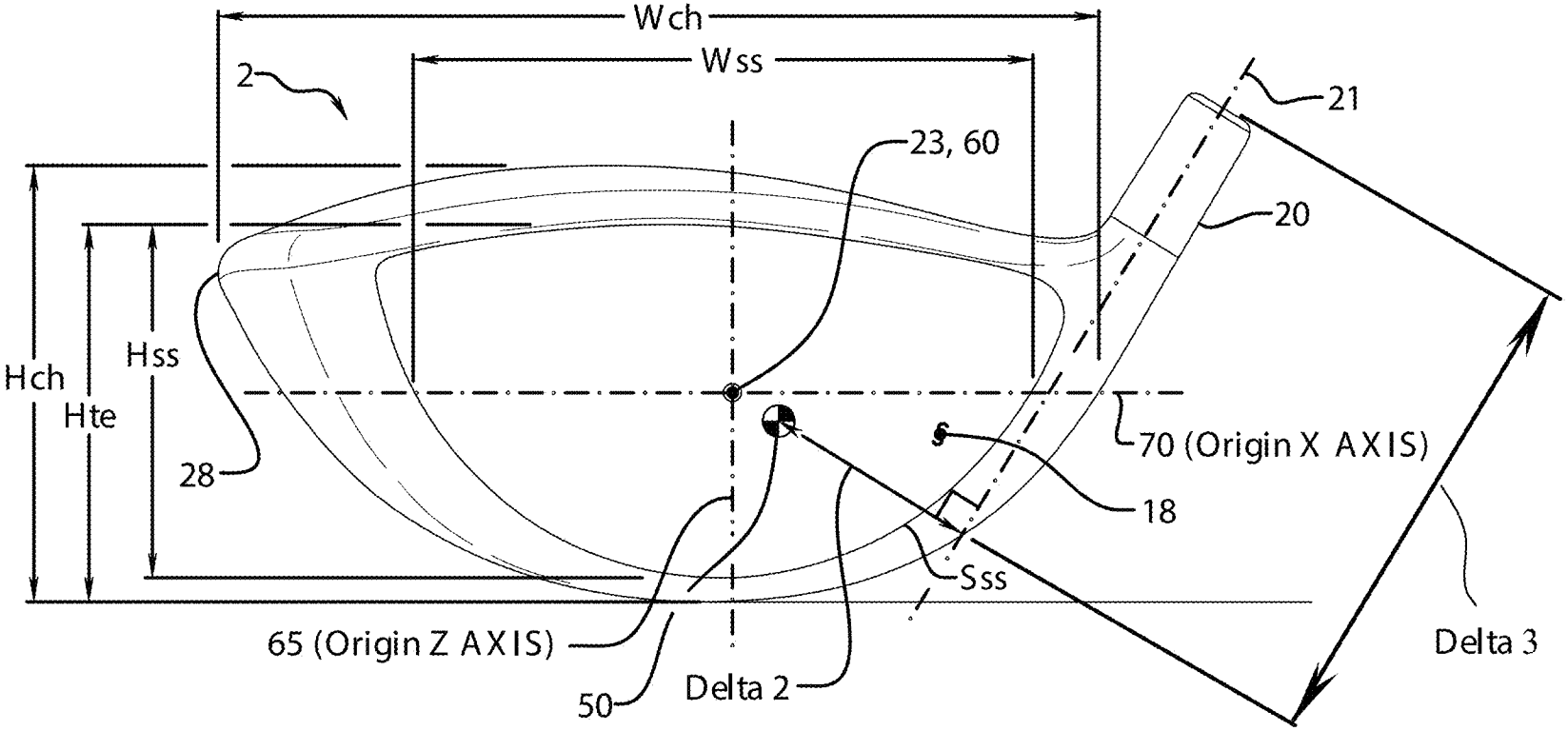
FIG. 8 is a front side view of a golf club head according to an embodiment.

Referring to FIGS. 7 and 8, the ideal impact location 23 of the golf club head 2 is disposed at the geometric center of the face 18. The ideal impact location 23 is typically defined as the intersection of the midpoints of a height Hss and a width Wss of the face 18. Both Hss and Wss are determined using the striking face curve Sss. The striking face curve is bounded on its periphery by all points where the face transitions from a substantially uniform bulge radius (face heel-to-toe radius of curvature) and a substantially uniform roll radius (face crown-to-sole radius of curvature) to the body. In the illustrated example, Hss is the distance from the periphery proximate to the sole portion of Sss to the periphery proximate to the crown portion of Sss measured in a vertical plane (perpendicular to ground) that extends through the geometric center of the face 18 (e.g., this plane is substantially normal to the x-axis). Further, as seen in FIG. 8, the face 18 has a top edge elevation, Hte, measured from the ground plane. Similarly, Wss is the distance from the periphery proximate to the heel portion of Sss to the periphery proximate to the toe portion of Sss measured in a horizontal plane (e.g., substantially parallel to ground) that extends through the geometric center of the face (e.g., this plane is substantially normal to the z-axis). See USGA "Procedure for Measuring the Flexibility of a Golf Clubhead," Revision 2.0 for the methodology to measure the geometric center of the striking face. Additional specific implementations having additional specific values for face height Hss, face width Wss, and total striking surface area are described elsewhere herein.

In some embodiments, the striking face 18 is made of a composite material such as described in U.S. patent application Ser. Nos. 14/210,000, 14/154,513, 14/620,079, 14/184,585, and U.S. Pat. No. 9,174,099, and others disclosed herein, each of which is incorporated in its entirety herein by reference. In other embodiments, the striking face 18 is made from a metal alloy (e.g., an alloy of titanium, steel, aluminum, and/or magnesium), ceramic material, or a combination of composite, metal alloy, and/or ceramic materials. Examples of titanium alloys include alpha alloys including, but not limited to, Ti-5AL-2SN-ELI, Ti-8AL-1MO-1V, Ti-9AL-1MO-1V; near-alpha alloys including, but not limited to, Ti-6Al-2Sn-4Zr-2Mo, Ti-5Al-5Sn-2Zr-2Mo, IMI 685, Ti 1100, Ti-8Al-1Mo-1V, Ti-9AL-1MO-1V; alpha and beta alloys including, but not limited to, Ti-6Al-4V, Ti-6Al-4V-ELI, Ti-6Al-6V-2Sn; and beta and near beta alloys including, but not limited to, Ti-10V-2Fe-3Al, Ti-13V-11Cr-3Al, Ti-8Mo-8V-2Fe-3Al, Beta C, Ti-15-3. Additional examples of titanium alloys include 3-2.5, 6-4, SP700, 15-3-3-3, 10-2-3, or other alpha/near alpha, alpha-beta, and beta/near beta titanium alloys. Examples of steel alloys include 304, 410, 450, or 455 stainless steel. In several specific embodiments, the golf club head includes a body 10 that is formed of a metal (e.g., titanium), a metal alloy (e.g., an alloy of titanium, an alloy of aluminum, and/or an alloy of magnesium), a composite material, such as a graphitic composite, a ceramic material, an injection molded material, such as those disclosed in U.S. patent application Ser. No. 14/717,864, which is incorporated herein by reference in its entirety, or any combination thereof.

When at normal address position as seen in FIG. 3, the club head 2 is disposed at a lie-angle 19 relative to the club shaft axis 21 and the club face 18 has a loft angle 15. The lie-angle 19 refers to the angle between the centerline axis 21 of the club shaft and the ground plane 17 at the normal address position. Referring to FIG. 2, loft-angle 15 refers to the angle between a tangent line to the club face 18 and a vector normal to the ground plane 29 at normal address position.

A club shaft and/or shaft sleeve is received within the hosel bore 24 and is aligned with the centerline axis 21. In some embodiments, a connection assembly is provided that allows the shaft to be easily disconnected from the club head 2. In still other embodiments, the connection assembly provides the ability for the user to selectively adjust the loft-angle 15 and/or lie-angle 19 of the golf club. For example, in some embodiments, a sleeve is mounted on a lower end portion of the shaft and is configured to be inserted into the hosel bore 24.

In one embodiment the sleeve has an upper portion defining an upper opening that receives the lower end portion of the shaft, and a lower portion having a plurality of longitudinally extending, angularly spaced external splines located below the shaft and adapted to mate with complimentary splines in the hosel opening 24. The complimentary spines in the hosel opening 24 may be a separate piece called a collar. The lower portion of the sleeve defines a longitudinally extending, internally threaded opening adapted to receive a screw for securing the shaft assembly to the club head 2 when the sleeve is inserted into the hosel opening 24. The club head 2 may include a shaft connection assembly as disclosed in U.S. patent application Ser. Nos. 14/876,694 and 14/587,573, each of which is incorporated herein by reference in its entirety, and some embodiments are described later herein. In another embodiment, in lieu of the splines, the upper portion of the sleeve has at least one alignment feature, sometimes referred to as tangs, that cooperates with a corresponding feature, or features, along the exterior perimeter of the hosel entrance, which may include a notch, or notches, that extend all the way through the hosel sidewall or only partially into the interior, or exterior, of the hosel sidewall. In one particular embodiment a ferrule is integrally formed as part of the sleeve and at least two tangs extend from the ferrule to cooperate with at least two notches formed in the end of the hosel.

In another embodiment the connection assembly includes at least one external shim, or wedge member, that fits around, and cooperates with, a portion of the sleeve, outside of the club head, and cooperates with a portion of the hosel, thereby permitting a user to adjust the loft, lie, and/or face angle of the golf club head, either dependently or independently without requiring the user to remove the shaft completely from the hosel. In one embodiment the at least one external shim is a tubular adjustment piece having non-parallel upper and lower surfaces, which encircles a central portion of the shaft sleeve so that the upper surface cooperates with an upper end of the shaft sleeve to releasably fix the tubular adjustment piece to the shaft sleeve. A fastener secures the shaft sleeve to the club head and brings a portion of the at least one external shim into engagement with a portion of the club head, which in a further embodiment prevents rotation of the at least one external shim and by default the shaft sleeve. In an embodiment the shim is a cylindrical adjustment piece with an upper surface that is not parallel with its lower surface, such that it has an angle $\alpha$ and tilts the shaft sleeve when the shim is sandwiched between the upper portion of the shaft sleeve, or another shim, and the hosel. The shim may include a first plurality of teeth that are sized to mate with matching alignment features on the hosel, and a second plurality of teeth sized to mate with matching alignment features on another shim. In still a further embodiment the at least one external shim may be a portion of a hosel sleeve, whereby a portion of the hosel sleeve extends into the hosel and possesses a central bore for receiving the shaft sleeve, while the external shim portion remains external to the club head.

Golf Club Head Coordinates

Referring to FIGS. 6-8, a club head origin coordinate system can be defined such that the location of various features of the club head 2 including a club head center-of-gravity (CG) 50. A club head origin 60 is illustrated on the club head 2 positioned at the ideal impact location 23, or geometric center, of the face 18.

The head origin coordinate system defined with respect to the head origin 60 includes three axes: a z-axis 65, seen in FIG. 7, extending through the head origin 60 in a generally vertical direction relative to the ground 17 when the club head 2 is at the normal address position; an x-axis 70, seen in FIG. 6, extending through the head origin 60 in a toe-to-heel direction generally parallel to the face 18, e.g., generally tangential to the face 18 at the ideal impact location 23, and generally perpendicular to the z-axis 65; and a y-axis 75, seen in FIG. 7, extending through the head origin 60 in a front-to-back direction and generally perpendicular to the x-axis 70 and to the z-axis 65. The x-axis 70 and the y-axis 75 both extend in generally horizontal directions relative to the ground 17 when the club head 2 is at normal address position. The x-axis 70 extends in a positive direction from the origin 60 to the heel 26 of the club head 2. The y-axis 75 extends in a positive direction from the origin 60 towards the rear portion 32 of the club head 2. The z-axis 65 extends in a positive direction from the origin 60 towards the crown 12. Thus, if the club head CG 50 is located 5 mm toward the heel from the head origin 60, and 5 mm below the head origin 60, and 25 mm behind the head origin 60, the head origin x-axis (CGx) coordinate would be 5 mm, the head origin y-axis (CGy) coordinate would be 25 mm, and the head origin z-axis (CGz) coordinate would be −5 mm.

An alternative, above ground, club head coordinate system places the origin 60 at the intersection of the z-axis 65 and the ground plane 17, providing positive z-axis coordinates for every club head feature. As used herein, "Zup" means the CG z-axis location determined according to the above ground coordinate system. Zup generally refers to the height of the CG 50 above the ground plane 17. Another alternative coordinate system uses the club head center-of-gravity (CG) 50 as the origin when the club head 2 is at normal address position. Each center-of-gravity axis passes through the CG 50. For example, the CG x-axis 90, seen in FIG. 6, passes through the center-of-gravity 50 substantially parallel to the ground plane 17 and generally parallel to the origin x-axis 70 when the club head 2 is at normal address position. Similarly, the CG y-axis 95 passes through the center-of-gravity 50 substantially parallel to the ground plane 17 and generally parallel to the origin y-axis 75, and the CG z-axis 85, seen in FIG. 7, passes through the center-of-gravity 50 substantially perpendicular to the ground plane 17 and generally parallel to the origin z-axis 65 when the club head 2 is at normal address position.

Mass Moments of Inertia

Referring to FIGS. 6-7, club head moments of inertia are typically defined about the three CG axes that extend through the golf club head center-of-gravity 50.

For example, a moment of inertia about the golf club head CG z-axis 85 can be calculated by the following equation:

$$Izz = \int (x^2 + y^2)\,\mathrm{dm}$$

where x is the distance from a golf club head CG yz-plane to an infinitesimal mass, dm, and y is the distance from the golf club head CG xz-plane to the infinitesimal mass, dm. The golf club head CG yz-plane is a plane defined by the golf club head CG y-axis 95 and the golf club head CG z-axis 85.

The moment of inertia about the CG z-axis (Izz) is an indication of the ability of a golf club head to resist twisting about the CG z-axis. Greater moments of inertia about the CG z-axis (Izz) provide the golf club head 2 with greater forgiveness on toe-ward or heel-ward off-center impacts with a golf ball. In other words, a golf ball hit by a golf club head 2 on a location of the striking face 18 between the toe 28 and the ideal impact location 23 tends to cause the golf club head 2 to twist rearwardly and the golf ball to draw (e.g., to have a curving trajectory from right-to-left for a right-handed swing). Similarly, a golf ball hit by a golf club head 2 on a location of the striking face 18 between the heel 26 and the ideal impact location 23 causes the golf club head 2 to twist forwardly and the golf ball to slice (e.g., to have a curving trajectory from left-to-right for a right-handed swing). Increasing the moment of inertia about the CG z-axis (Izz) reduces forward or rearward twisting of the club head 2, reducing the negative effects of heel or toe mis-hits.

A moment of inertia about the golf club head CG x-axis 90 can be calculated by the following equation:

$$Ixx = \int (y^2 + z^2)\,\mathrm{dm}$$

where y is the distance from a golf club head CG xz-plane to an infinitesimal mass, dm, and z is the distance from a golf club head CG xy-plane to the infinitesimal mass, dm. The club head CG xz-plane is a plane defined by the golf club head CG x-axis 90 and the club head CG z-axis 85. The CG xy-plane is a plane defined by the golf club head CG x-axis 90 and the golf club head CG y-axis 95.

As the moment of inertia about the CG z-axis (Izz) is an indication of the ability of a club head 2 to resist twisting about the CG z-axis, the moment of inertia about the CG x-axis (Ixx) is an indication of the ability of the club head 2 to resist twisting about the CG x-axis. In general, greater moments of inertia about the CG x-axis (Ixx) improve the forgiveness of the club head 2 on high and low off-center impacts with a golf ball. In other words, a golf ball hit by a club head 2 on a location of the striking surface 18 above the ideal impact location 23 causes the club head 2 to twist upwardly and the golf ball to have a higher trajectory than desired. Similarly, a golf ball hit by a club head 2 on a location of the striking face 18 below the ideal impact location 23 causes the club head 2 to twist downwardly and the golf ball to have a lower trajectory than desired. Increasing the moment of inertia about the CG x-axis (Ixx) reduces upward and downward twisting of the club head 2, reducing the negative effects of high and low mis-hits. However, for better players, a lower moment of inertia may be preferred for improved ball flight shaping.

A moment of inertia about the golf club head shaft axis 21 is referred to as the hosel axis moment of inertia (Ih) and is calculated in a similar manner and is an indication of the ability of the club head 2 to resist twisting about the shaft axis 21, and also serves as a measure of the resistance a golfer senses during a golf swing as they attempt to bring the club head 2 back to a square position to impact a golf ball.

Club Head Height, Width, and Depth

In addition to redistributing mass within a particular club head envelope as discussed immediately above, the club head center-of-gravity location 50 can also be tuned by modifying the club head external envelope. Referring now to FIGS. 7 and 8, the club head 2 has a maximum club head height Hch defined as the maximum above ground z-axis coordinate of the outer surface of the crown 12. Similarly, a maximum club head width Wch can be defined as the distance between the maximum extents of the heel and toe portions 26, 28 of the body measured along an axis parallel to the x-axis when the club head 2 is at normal address position and a maximum club head depth Dch, or length, defined as the distance between the forwardmost and rearwardmost points on the surface of the body 10 measured along an axis parallel to the y-axis when the club head 2 is at normal address position. Generally, the height and width of club head 2 should be measured according to the USGA "Procedure for Measuring the Clubhead Size of Wood Clubs" Revision 1.0. The heel portion 28 of the club head 2 is broadly defined as the portion of the club head 2 from a vertical plane passing through the origin y-axis 75 toward the hosel 20, while the toe portion 26 is that portion of the club head 2 on the opposite side of the vertical plane passing through the origin y-axis 75.

Figure 10:
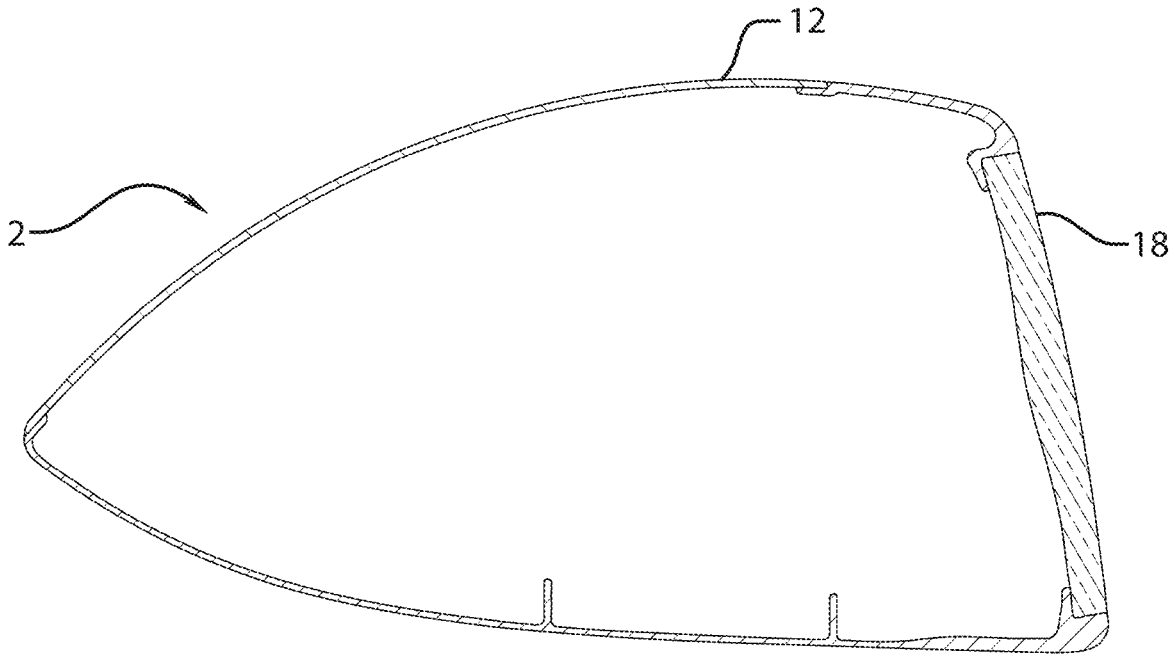
FIG. 10 is a cross-sectional view of a golf club head according to an embodiment.

In one embodiment the present club head 2 avoids such face heavy characteristics by incorporating a low-density material in at least a portion of the face 18, which may be metallic or non-metallic. As such, one particular embodiment has an average face density of less than 4 g/cc, while in another embodiment the average face density is less than 3 g/cc, and in yet another embodiment the average face density is less than 2 g/cc. In one particular embodiment, such as that seen in FIG. 10, at least 50% of the face area is composed of non-metallic material, such as that disclosed in U.S. patent application Ser. Nos. 14/210,000, 14/184,585, and 14/154,513, the entire contents of which are herein incorporated by reference in their entirety. Such non-metallic materials may be on the outer, or striking side, of the face, or may be on the interior side of the face to provide support or reinforcing without actually coming in contact with the golf ball. In another embodiment at least 75% of the face area is composed of non-metallic material, while in an even further embodiment the entire face area is composed of non-metallic material, which provides roughly 5 grams of mass savings for every 500 $mm^2$ of face area, when compared to traditional titanium alloy face constructions. Therefore, a club head 2 having a face area of 5500 $mm^2$ may save 20 grams by using an entirely non-metallic face 18, which then provides great flexibility in reallocating the location of this discretionary mass to beneficially control the mass properties of the club head 2 and achieve one or more of the performance enhancing relationships disclosed herein, as well as increase or decrease the volume to levels not seen in club heads 2 that maintain traditional head weights. This is particularly beneficial in lightweight club heads 2 that traditionally lack the discretionary weight needed to effectively place the CG in a beneficial location. In another embodiment the club head 2 has a face insert and face insert support, as seen in FIG. 10, such as that disclosed in U.S. patent application Ser. No. 14/699,905, the entire contents of which are herein incorporated by reference in its entirety. In another embodiment the entire face insert is non-metallic and has a mass less than 60 grams, which in a further embodiment is less than 55 grams, and in yet another embodiment is less than 50 grams. Still further, in another embodiment the face 2 has a variable face thickness, such as that disclosed in U.S. patent application Ser. Nos. 14/565,311 and 14/456,927, the entire contents of which are herein incorporated by reference in its entirety. In one particular embodiment the average face thickness is in the range of from about 1.0 mm to about 5.5 mm, while in another embodiment it is from about 1.5 mm to 5.0 mm, and in yet a further embodiment it is from about 2.0 mm to 4.5 mm.

In yet another embodiment the club head 2 has a construction and characteristic time, or CT, profile as disclosed in U.S. patent application Ser. No. 14/862,438, the entire contents of which are herein incorporated by reference in its entirety. In one particular embodiment the CT value at the ideal impact location is at least 280 microseconds, while in an even further embodiment it is at least 290 microseconds, and in yet another embodiment it is at least 300 microseconds. Additionally, in another embodiment the characteristic time at points along a horizontal axis through the ideal impact location 23, between a distance of 40 mm and −40 mm from the ideal impact location 23, deviate less than 20% from the characteristic time at the ideal impact location 23, while in a further embodiment the deviation is less than 15% from the characteristic time at the ideal impact location 23, and in yet another embodiment the deviation is less than 10% from the characteristic time at the ideal impact location 23.

The CG location is important in every club head, but even more so in club heads of the embodiments described herein. Traditionally designers have sought to increase the CG depth but the embodiments of the present invention seeks to make the CG as forward as possible, illustrated by the small Delta1 and MOI values, Table 1. In some embodiments the CG location preferentially affects the Z-axis gear effect, which is particularly important in the club heads described herein. For instance, in certain embodiments disclosed herein, the projected CG point on the ball striking club face 18 is located below the geometric center of the club face 18, or ideal impact point 23. As shown in FIG. 7, a given golf club head having a given CG will have a projected center of gravity or "balance point", "BP", or "CG projection" that is determined by an imaginary line passing through the CG and oriented normal to the striking face 18. The location where the imaginary line intersects the striking face 18 is the CG projection or BP. The BP Proj. is defined as a distance above or below the center of the striking face 18 as measured along a plane that is tangent to the center of the face. The BP Proj. in Table 1 is a negative number indicating the balance point projection is below the center face location in a vertical direction as projected within a Z-Y plane through center face. The distance from the ground plane to the CG projection or BP may also be an advantageous measurement of golf head playability, and may be represented by a CG plane that is parallel to the ground plane. The distance from the ground plane to this CG plane representing CG projection on the face plate may be referred to as the balance point up (BP Proj. Up in Table 1). When the CG projection is well above the center of the face, impact efficiency, which is measured by COR, is not maximized. It has been discovered that a low CG projection or a CG projection located at or near the ideal impact location on the striking face 18 improves the impact efficiency of the golf club head 2 as well as initial ball speed. One important ball launch parameter, namely ball spin, is also improved. In some embodiments the projected CG point on the ball striking club face 18 is closer to the sole 14 than the geometric center of the face. As a result, when the golf club is swung such that the club head 2 impacts a golf ball at the ideal impact point 23, the impact is "off center" from the projected CG point, creating torque that causes the body 10 of the golf club head 2 to rotate (or twist) about the CG x-axis. The rotation of the club face 18 creates a "z-axis gear effect." More specifically, the rotation of the club head 2 about the CG x-axis tends to induce a component of spin on the ball. In particular, the backward rotation of the face 18 that occurs as the golf ball is compressed against the face 18 during impact causes the ball to rotate in a direction opposite to the rotation of the face 18, much like two gears interfacing with one another. Thus, the backward rotation of the club face 18 during impact creates a component of forward rotation in the golf ball. This effect is termed the "z-axis gear effect." Because the loft 15 of a golf club head 2 also creates a significant amount of backspin in a ball impacted by the golf club head 2, the forward rotation resulting from the z-axis gear effect is typically not enough to completely eliminate the backspin of the golf ball, but instead reduces the backspin from that which would normally be experienced by the golf ball. In general, the forward rotation (or topspin) component resulting from the z-axis gear effect is increased as the impact point of a golf ball moves upward from (or higher above) the projected CG point on the ball striking club face 18, and having a club head 2 and face 18 may promote strikes high on the face 18. Additionally, the effective loft of the golf club head 2 that is experienced by the golf ball and that determines the launch conditions of the golf ball can be different than the static loft 15 of the golf club head 2. The difference between the golf club head's effective loft at impact and its static loft angle 15 at address is referred to as "dynamic loft" and can result from a number of factors. In general, however, the effective loft of a golf club head is increased from the static loft 15 as the impact point of a golf ball moves upward from (or higher than) the projected CG point on the ball striking club face 18. Thus, a club head 2 with a low CG, or relatively small Zup value, and associated low projected CG point has preferred z-axis gear effect particularly when combined with an increased face height Hss that tends to promote impacts higher on the face 18. In a further embodiment the static loft angle 15 is at 8-20 degrees, while in another embodiment it is 11-18 degrees, and in yet a further embodiment it is 13-16 degrees.

The trajectory of a golf ball hit by a club head 2 having a projected CG that coincides with the geometric center of the striking surface, or ideal impact point 23, typically includes a low launch angle and a significant amount of backspin. The backspin on the ball causes it to quickly rise in altitude and obtain a more vertical trajectory, "ballooning" into the sky. Consequently, the ball tends to quickly lose its forward momentum as it is transferred to vertical momentum, eventually resulting in a steep downward trajectory that does not create a significant amount of roll. Even though some backspin can be beneficial to a golf ball's trajectory by allowing it to "rise" vertically and resist a parabolic trajectory, too much backspin can cause the golf ball to lose distance by transferring too much of its forward momentum into vertical momentum.

In contrast, the trajectory of a golf ball hit by a club head 2 having a lower center of gravity has a higher launch angle and less backspin relative to the club head 2 having a projected CG that coincides with the geometric center of the striking surface, and the trajectory includes less "ballooning" but still has enough backspin for the ball to have some rise and to generally maintain its launch trajectory longer than a ball with no backspin. As a result, the golf ball carries further because the horizontal momentum of the golf ball is greater, which also increases the roll-out upon landing.

As seen in FIG. 7, Delta1 is a measure of how far rearward in the club head body 10 the CG is located behind a vertical plane containing the shaft axis 21; and Zup is a measure of the vertical distance that the CG is located above the ground plane 17. Smaller values of Delta1 result in lower projected CGs on the club head face 18. Thus, for embodiments of the disclosed golf club heads in which the projected CG on the ball striking club face 18 is lower than the geometric center, reducing Delta1 can lower the projected CG and increase the distance between the geometric center and the projected CG. Recall also that a lower projected CG creates a higher dynamic loft and more reduction in backspin due to the z-axis gear effect. Thus, for particular embodiments of the disclosed golf club heads, the Delta1 values are relatively low, thereby reducing the amount of backspin on the golf ball and helping the golf ball obtain the desired high launch, low spin trajectory. FIG. 7 also shows a dimension CFY which is the distance from the center face to the plane containing the shaft axis 21 along the Y axis 75.

Figure 9:
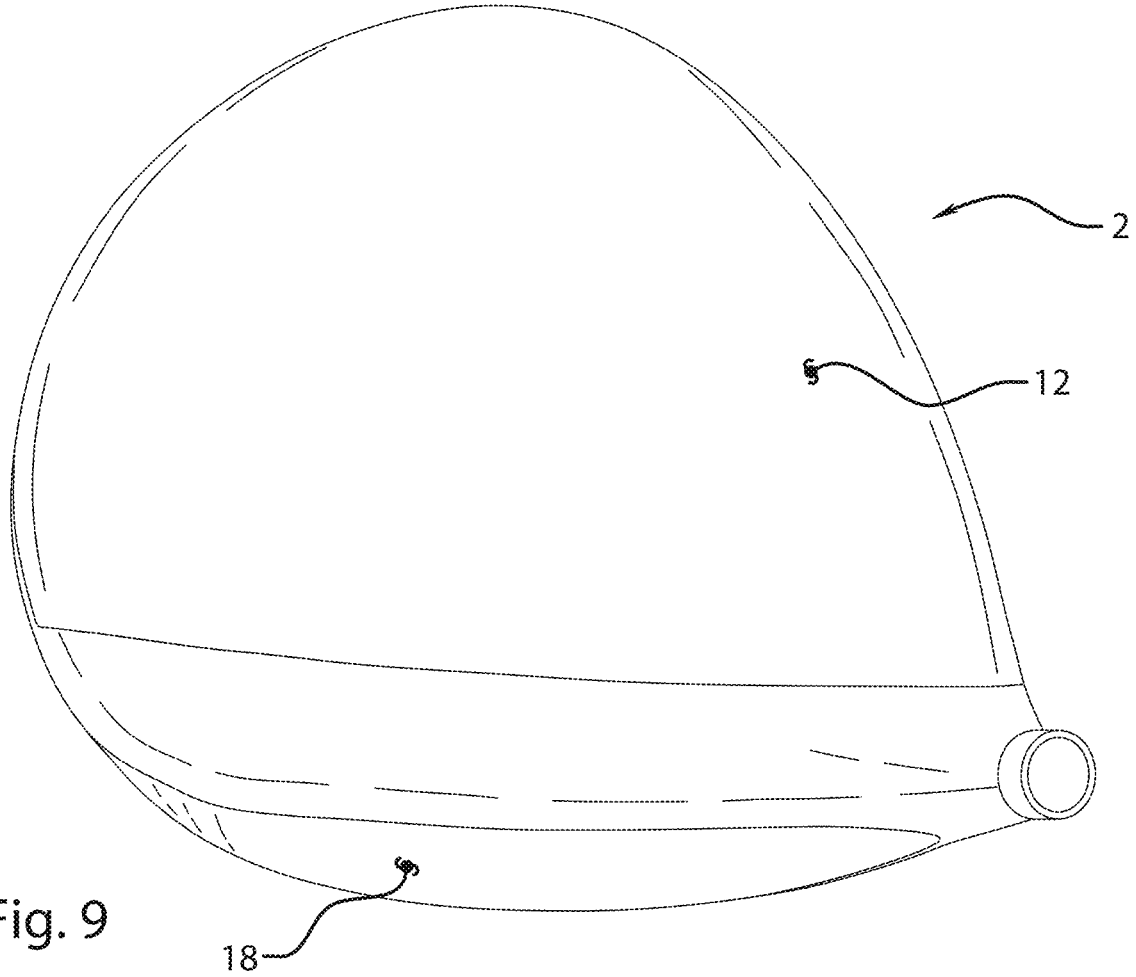
FIG. 9 is a top crown view of a golf club head according to an embodiment.

Adjusting the location of the discretionary mass in a golf club head 2, or the shape of the body 10 of the club head 2, can provide the desired Delta1 value. For instance, Delta1 can be manipulated by varying the mass in front of the CG (closer to the face) with respect to the mass behind the CG. That is, by increasing the mass behind the CG with respect to the mass in front of the CG, Delta1 can be increased. In a similar manner, by increasing the mass in front of the CG with the respect to the mass behind the CG, Delta1 can be decreased. The club heads shown in Tables 1 have a Delta1 value that is incredibly small. The shape of the body 10 may include any of the embodiments disclosed in U.S. patent applications Ser. Nos. 14/325,168, 14/144,105, and 14/629,160, which are incorporated herein by reference in their entirety. Additionally, at least one embodiment in Table 1 avoids the high CG location of the club heads by incorporating a low-density material in at least a portion of the crown 12, which may be metallic or non-metallic. As such, one particular embodiment has an average crown density of less than 4 g/cc, while in another embodiment the average crown density is less than 3 g/cc, and in yet another embodiment the average crown density is less than 2 g/cc. In one particular embodiment, such as that seen in FIGS. 9 and 10, at least 50% of the crown area is composed of non-metallic material. In another embodiment at least 75% of the crown area is composed of non-metallic material. In another embodiment at least 50% of the surface area of the body 10 located above the height of the ideal impact location 23 is formed of non-metallic materials, while in an even further embodiment the non-metallic surface area located above the height of the ideal impact location 23 is at least 7500 $mm^2$, and in another embodiment the mass of the non-metallic portions located above the height of the ideal impact location 23 is 25-50 grams, while the mass is 30-45 grams in another embodiment, and is 15-25% of the total club head weight in still a further embodiment. In another embodiment at least 50% of the surface area of the body 10 located below the height of the ideal impact location 23 is formed of non-metallic materials, while in an even further embodiment the non-metallic surface area located below the height of the ideal impact location 23 is at least 7500 $mm^2$, and in another embodiment the mass of the non-metallic portions located below the height of the ideal impact location 23 is 15-50 grams, while the mass is 20-45 grams in another embodiment, and is 10-25% of the total club head weight in still a further embodiment. The non-metallic materials, body components, and construction techniques include, but are not limited to, all embodiments disclosed in U.S. patent application Ser. Nos. 14/516,503, 14/210,000, 14/184,585, 14/154,513, 14/717,864, 15/233,805, 15/087,002, and 62/205,601, the entire contents of which are herein incorporated by reference in their entirety.

In one present embodiment, preferred z-axis gear effect and golf ball trajectory/launch characteristics are achieved in a club head (as shown in Table 1) when a volume-to-Delta1 ratio of the volume to the Delta1 value is between 50 cc/mm and 250 cc/mm or is between 70 cc/mm and 300 cc/mm, while in another embodiment the volume-to-Delta1 ratio is greater than 70 cc/mm, while in an even further embodiment the volume-to-Delta1 ratio is between 70 cc/mm and 240 cc/mm, and in yet another embodiment the volume-to-Delta1 ratio is between 70 cc/mm and 230 cc/mm. A further series of embodiments identified preferred performance and feel when the volume-to-Delta1 ratio is maintained above 25 cc/mm, while in another embodiment it is at least 30 cc/mm, and in yet a further embodiment is at least 35 cc/mm, while in one embodiment a preferred range was identified as 40-65 cc/mm, and 45-60 cc/mm in still a further embodiment.

In one preferred z-axis gear effect and golf ball trajectory/launch characteristics are achieved in a club head in Table 1 when a volume-to-Zup ratio of the volume to the Zup value is at least 16 cc/mm, while in another embodiment the ratio is at least 20 cc/mm, in yet a further embodiment it is at least 22 cc/mm, and in still another embodiment it is at least 24 cc/mm. Another series of embodiments limits the top end of the volume-to-Zup ratio to provide the desired performance with the volume-to-Zup ratio not exceeding 30 cc/mm, while in another embodiment the ratio does not exceed 28 cc/mm, and in still a further embodiment the ratio does not exceed 26 cc/mm. Similarly, another series of embodiments have a Zup-to-Delta1 ratio that is 2-15, while in another embodiment the ratio is 2.0-10.0, and it is 3.0 to 15.0 in an even further embodiment. An even further series of embodiments a volume-to-Zup/Delta1 (i.e. Volume/(Zup/Delta1)) ratio of the volume to the Zup-to-Delta1 ratio that is at least 300 cc, while at least 320 cc in another embodiment, and at least 340 cc in yet a further embodiment; and further embodiments cap this ratio at no more than 400 cc in a first embodiment, no more than 380 cc in a second embodiment, and no more than 360 cc in a third embodiment. Ratios outside of these ranges unexpectedly produced a feeling in instability at impact, particularly on mis-hits, and may be more difficult to return to a square position at impact with the golf ball. In another embodiment preferred z-axis gear effect and trajectory are achieved in a club head 2, when the Delta1 value is at least 9% of the head depth Dch, while in another embodiment the Delta1 value is no more than 14% of the head depth Dch, while in an even further embodiment the Delta1 value is 10-13% of the head depth Dch. In an even further embodiment preferred z-axis gear effect and trajectory are achieved in a club head 2 when the Delta1 value is at least 10 mm, while in a further embodiment the Delta1 value is no more than 20 mm, while in yet a further embodiment the Delta1 value is no more than 18 mm, and in still a further embodiment the Delta1 value is no more than 16 mm.

As seen in FIG. 8, a Delta2 value is another important dimension used in quantifying the location of the center of gravity 50, which also influences the performance of the club head 2. First, create an imaginary vertical shaft axis plane containing the shaft axis 21. Next, project the center of gravity 50 forward, along the CG y axis 95, seen in FIG. 6, until it strikes the imaginary vertical shaft axis plane thereby defining a point referred to as the D2 point. The shortest distance from the D2 point to the shaft axis 21 is the Delta2 value, thus the Delta2 value is the distance from the D2 point to a shaft-axis-intersection point within the imaginary vertical shaft axis plane. Therefore, an imaginary triangle may be created starting at the center of gravity 50 with a first leg along the CG y axis 95 with a magnitude of the Delta1 value; a second leg within the imaginary vertical shaft axis plane extends from the D2 point to the shaft-axis-intersection point, and has a magnitude of the Delta2 value; and the hypotenuse of the triangle extends from the shaft-axis-intersection point to the center of gravity 50. The CG angle is the angle between the second leg and the hypotenuse. Therefore, the tangent of the CG angle is equal to the D1 value divided by the D2 value, allowing for easy calculation of the CG angle. As referred to herein, the terms "D1" and "Delta1" refer to the same dimension as shown in FIG. 7. In addition, the terms "D2" and "Delta2" refer to the same dimension as shown in FIG. 8. Finally, the terms "D3 and "Delta3" refer to the same dimension as shown in FIG. 8.

As shown in FIG. 8 and described in Table 1, Delta3 or D3 is the dimension that describes the distance of the CG relative to a plane that is perpendicular to the shaft axis 21 located at the top edge of the hosel 21. The D3 is measured along the shaft axis 21.

Another important influencer of z-axis gear effect is the curvature of the face 18. Bulge and roll are golf club face 18 properties that are generally used to compensate for gear effect. The term "bulge" on a golf club head 2 refers to the rounded properties of the golf club face 18 from the heel 26 to the toe 28 of the club face 18. The term "roll" on a golf club head 2 refers to the rounded properties of the golf club face 18 from the crown 12 to the sole 14 of the club face 18. The roll radius R refers to the radius of a circle having an arc that corresponds to the arc along the z-axis of the ball striking club face 18. Curvature is the inverse of radius and is defined as 1/R, where R is the radius of the circle having an arc corresponding to the arc along the z-axis of the ball striking club face 18. As an example, a roll with a curvature of 0.0050 $mm^{-1}$ corresponds to a roll with a radius of 200 mm. The process for measuring bulge and roll is disclosed later herein.

In the embodiments described herein, a "flatter" bulge and "rounder" roll is preferred in light of the unique head properties described in Table 1. For example, a roll radius of 266.7 mm and a bulge radius of 304.8 mm could be used. In some embodiments, the bulge radius is larger than the roll radius. In some embodiments the bulge radius divided by the roll radius has a bulge/roll ratio that is greater than 1 and less than 2 or between land 1.75.

The roll of the golf club head 2 can contribute to the amount of backspin that the golf ball acquires when it is struck by the club head 2 at a point on the club face 18 either above or below the projected CG of the club head 2. For example, shots struck at a point on the club face 18 above the projected CG have less backspin than shots struck at or below the projected CG. If the roll radius of the club head 2 is decreased, there will be a decreased variance between backspin for shots struck above the projected CG of the golf club face 18 and shots struck below the projected CG of the ball striking club face 18. In certain embodiments of the disclosed golf club heads 2, the roll radius is relatively large (e.g., greater than or equal to 300 mm). Thus, for embodiments of the disclosed golf club heads 2 in which the projected CG on the ball striking club face is lower than the geometric center 23, the higher roll radius operates to enhance the z-axis gear effect when a ball is struck at the geometric center, thereby reducing the amount of backspin on the golf ball and helping the golf ball obtain the desired high launch, low spin trajectory.

In one embodiment the head weight of the club head 2, including any weights, moveable or otherwise, and loft/lie adjustment sleeves/systems, is less than 210 grams. Often club heads are in excess of 275 grams and therefore the associated golf club would need to be unusually short to provide a swing weight that feels comfortable to most golfers, as disclosed later in detail. Achieving the desired lightweight golf club head 2 is no easy task, particularly when trying to achieve any of the other performance enhancing relationships and/or constructions disclosed herein. In another embodiment the head weight is less than 200 grams, while in a further embodiment the head weight is less than 190 grams. A particularly effective series of embodiments has identified a synergistic balance of the pros and cons of lightweight club heads 2 in the range of 185-205 grams, while in an even further embodiment the head weight is 195-205 grams, and in an even further embodiment the head weight is 190-200 grams. One particular embodiment includes an adjustment system such as that disclosed in U.S. patent application Ser. Nos. 14/871,789, 14/939,648, 14/876,694, 14/587,573, 14/565,311, the entire contents of which are herein incorporated by reference in their entirety.

The method used to obtain the bulge and roll values in the present disclosure is the optical comparator method. The club face includes a series of score lines which traverse the width of the club face generally along the X-axis of the club head. In the optical comparator method, the club head is mounted face down and generally horizontal on a V-block mounted on an optical comparator. The club head is oriented such that the score lines are generally parallel with the X-axis of the optical comparator. Measurements are then taken at the geometric center point on the club face. Further measurements are then taken 20 millimeters away from the geometric center point of the club face on either side of the geometric center point 5*a* and along the X-axis of the club head, and 30 millimeters away from the geometric center point of the club face on either side of the center point and along the X-axis of the club head. An arc is fit through these five measure points, for example by using the radius function on the machine. This arc corresponds to the circumference of a circle with a given radius. This measurement of radius is what is meant by the bulge radius. In one embodiment of the present invention the bulge is at least 300 mm, while in a further embodiment it is at least 350 mm. Further, additional embodiments ensure the bulge does not become too large and negatively influence performance by having a bulge that is no more than 700 mm, and one particularly effective embodiment has a bulge that is 300-800 mm.

To measure the roll, the club head is rotated by 90 degrees such that the Z-axis of the club head is generally parallel to the X-axis of the machine. Measurements are taken at the geometric center point of the club face. Further measurements are then taken 15 millimeters away from the geometric center point and along the Z-axis of the club face on either side of the center point, and 20 millimeters away from the geometric center point and along the Z-axis of the club face on either side of the geometric center point. An arc is fit through these five measurement points. This arc corresponds to the circumference of a circle with a given radius. This measurement of radius is what is meant by the roll radius. In one embodiment of the present invention the roll is at least 300 mm, while in a further embodiment the roll is less than 325 mm. Further, additional embodiments ensure the roll does not become too large and negatively influence performance by having a roll that is no more than 400 mm, and one particularly effective embodiment has a roll that is 240-375 mm, or preferably 240-300 mm.

As previously expressed, aerodynamic drag associated with a golf club head 2 is significant compared to a smaller conforming golf club head, to the point that it not only may reduce the swing speed but also impacts a golfer's ability to consistently return the club face 18 to the square position at the time of impact with the golf ball. Therefore, the club head 2 may incorporate any of the acrodynamic features, contours, and elements described in U.S. patent application Ser. Nos. 15/012,880, 14/789,263, 15/002,471, 14/330,205, 14/629,160, and others disclosed herein, which are incorporated herein by reference in their entirety. Additionally, as explained in detail in U.S. patent application Ser. No. 15/255,638, which is incorporated herein by reference in its entirety, preferential acrodynamic shaping of the body 10, and particularly the crown 12, tend to result in a high center of gravity 50 especially in a club head, and thus a large Zup dimension.

Preferably, the overall frequency of the golf club head 2, i.e., the average of the first mode frequencies of the crown 12, sole 14, and skirt 16 portions of the club head 2, generated upon impact with a golf ball is greater than 3,000 Hz. Frequencies above 3,000 Hz provide a user of the golf club with an enhanced feel and satisfactory auditory feedback, while in some embodiments frequencies above 3,200 Hz are obtained and preferred. However, a golf club head 2 having relatively thin walls and/or a thin bulbous crown 12, can reduce the first mode vibration frequencies to undesirable levels. The club head 2 may incorporate a plurality of ribs positioned on an internal surface to achieve the desired frequency, such as, but not limited to, those disclosed in U.S. patent application Ser. Nos. 14/525,540 and 14/284,813, which are incorporated herein by reference in their entirety. In another embodiment the club head 2 includes contrast enhancing features including any of those disclosed in U.S. patent application Ser. Nos. 14/302,817 and 14/638,829, which are incorporated herein by reference in their entirety. In still a further embodiment the club head 2 has a surface covering including any of those disclosed in U.S. patent application Ser. No. 14/803,735, which is incorporated herein by reference in its entirety.

Logically the club head 2 is attached to a shaft, often via an adjustability sleeve, with the shaft having a grip, to create a golf club having a club length. The club length is measured according to the current edition of the United States Golf Association's "Procedure for Measuring the Length of Golf Clubs (Excluding Putters)." One skilled in the art is familiar with U.S. Pat. No. 1,953,916 titled "Apparatus for Measuring Moments of Golf Clubs and the Like," which discloses an instrument for measuring the amount of torque the weight of an object exerts about a pivoting fulcrum located 14" from the end of the object. This device is particularly well known in the field of golf equipment. In one embodiment, the golf club has a club length of at least 43.5" and produces a torque of 5500-7000 gram*inches about a fulcrum located 14" from the butt end of the grip, which is easily measured using such a swing weight apparatus and roughly equates to a swing weight of C3 through E7 on what is commonly referred to as the "Lorythmic" scale. In another embodiment, the golf club has a club length of at least 43.5" and produces a torque of 6050-6500 gram*inches about a fulcrum located 14" from the butt end of the grip, which is easily measured using such a swing weight apparatus and roughly equates to a swing weight of DO through D9 on the "Lorythmic" scale, while in a further embodiment the club length is at least 44.0". In still a further embodiment the golf club has a club length of at least 44.0" and produces a torque of 6050-6300 gram*inches about a fulcrum located 14" from the butt end of the grip, which is easily measured using such a swing weight apparatus and roughly equates to a swing weight of DO through D5 on the "Lorythmic" scale.

Discretionary Mass

Desired club head mass moments of inertia, club head center-of-gravity locations, and other mass properties of a golf club head can be attained by distributing club head mass to particular locations. Discretionary mass generally refers to the mass of material that can be removed from various structures providing mass that can be distributed elsewhere for tuning one or more mass moments of inertia and/or locating the club head center-of-gravity.

Club head walls provide one source of discretionary mass, as does lightweight non-metallic components, such as crown inserts, face inserts, sole inserts, and composite head components, as disclosed in U.S. patent application Ser. Nos. 14/734,181, 14/516,503, 14/717,864, 15/233,805, 15/087,002, and 62/205,601, the entire contents of which are incorporated herein by reference in their entirety. A reduction in wall thickness reduces the wall mass and provides mass that can be distributed elsewhere. For example, in some implementations, one or more walls of the club head 2 can have a thickness (constant or average) less than approximately 0.7 mm, such as between about 0.55 mm and about 0.65 mm. In some embodiments, the crown 12 can have a thickness (constant or average) of approximately 0.60 mm or approximately 0.65 mm throughout more than about 70% of the crown, with the remaining portion of the crown 12 having a thickness (constant or average) of approximately 0.76 mm or approximately 0.80 mm. In addition, the skirt 16 can have a similar thickness and the wall of the sole 14 can have a thickness of between approximately 0.6 mm and approximately 2.0 mm.

Thin walls, particularly a thin crown 12, provide significant discretionary mass compared to conventional club heads. For example, a club head 2 made from an alloy of steel can achieve about 4 grams of discretionary mass for each 0.1 mm reduction in average crown thickness. Similarly, a club head 2 made from an alloy of titanium can achieve about 2.5 grams of discretionary mass for each 0.1 mm reduction in average crown thickness. Discretionary mass achieved using a thin crown 12, e.g., less than about 0.65 mm, can be used to tune one or more mass moments of inertia and/or center-of-gravity location.

To achieve a thin wall on the club head body 10, such as a thin crown 12, a club head body 10 can be formed from an alloy of steel or an alloy of titanium. Thin wall investment casting, such as gravity casting in air for alloys of steel and centrifugal casting in a vacuum chamber for alloys of titanium, provides one method of manufacturing a club head body with one or more thin walls.

Weights and Weight Ports and Weight Channels

Various approaches can be used for positioning discretionary mass within a golf club head 2. For example, many club heads 2 have integral sole weight pads cast into the head at predetermined locations that can be used to lower, to move forward, to move rearward, or otherwise to adjust the location of the club head's center-of-gravity. Also, epoxy can be added to the interior of the club head through the club head's hosel opening to obtain a desired weight distribution. Alternatively, weights formed of high-density materials can be attached to the sole, skirt, and other parts of a club head, including channels formed within the body, on the body, and/or projecting from the body. With such methods of distributing the discretionary mass, installation is critical because the club head endures significant loads during impact with a golf ball that can dislodge the weight. Accordingly, such weights are usually permanently attached to the club head and are limited to a fixed total mass, which of course, permanently fixes the club head's center-of-gravity and moments of inertia.

Alternatively, the golf club head 2 can define one or more weight ports or channels formed in the body 10 that are configured to receive one or more weights. For example, one or more weight ports can be disposed in the crown 12, skirt 16 and/or sole 14. The weight port and/or channel can have any of a number of various configurations to receive and retain any of a number of weights or weight assemblies, such as described in U.S. patent application Ser. Nos. 14/871,789, 14/939,648, 14/575,745, 14/266,608, 14/509,966, 14/843,605, 14/508,981, 14/861,881, 14/875,554, 14/789,838, 13/956,046, 15/004,509, 15/233,805, 15/087,002, and 62/205,601, and U.S. Pat. Nos. 7,407,447 and 7,419,441, which are incorporated herein by reference in their entirety.

Coefficient of Restitution and Characteristic Time

Another parameter that contributes to the forgiveness and successful playability and desirable performance of a golf club 2 is the coefficient of restitution (COR) and Characteristic Time (CT) of the golf club head 2. Upon impact with a golf ball, the club head's face 18 deflects and rebounds, thereby imparting energy to the struck golf ball. The club head's coefficient of restitution (COR) is the ratio of the velocity of separation to the velocity of approach. A thin face plate generally will deflect more than a thick face plate. Thus, a properly constructed club with a thin, flexible face plate can impart a higher initial velocity to a golf ball, which is generally desirable, than a club with a thick, rigid face plate. It typically is desirable to incorporate thin walls and a thin face plate into the design of the club head. Thin walls and the incorporation of lightweight materials afford the designers additional leeway in distributing club head mass to achieve desired mass distribution, and a thinner face plate may provide for a relatively higher COR as well as provide more discretionary mass to achieve the desired mass distribution.

Thus, selective use of thin walls is important to a club's performance. However, overly thin walls can adversely affect the club head's durability. Problems also arise from stresses distributed across the club head upon impact with the golf ball, particularly at junctions of club head components, such as the junction of the face plate with other club head components (e.g., the sole, skirt, and crown). One prior solution has been to provide a reinforced periphery about the face plate, such as by welding, in order to withstand the repeated impacts. Another approach to combat stresses at impact is to use one or more ribs extending substantially from the crown to the sole vertically, and in some instances extending from the toe to the heel horizontally, across an inner surface of the face plate. These approaches tend to adversely affect club performance characteristics, e.g., diminishing the size of the sweet spot, and/or inhibiting design flexibility in both mass distribution and the face structure of the club head. Thus, these club heads fail to provide optimal MOI, CG, and/or COR parameters, and as a result, fail to provide much forgiveness for off-center hits for all but the most expert golfers.

In addition to the thickness of the face plate and the walls of the golf club head, the location of the center of gravity also has a significant effect on the COR of a golf club head. For example, a given golf club head having a given CG will have a projected center of gravity or "balance point" or "CG projection" that is determined by an imaginary line passing through the CG and oriented normal to the striking face 18. The location where the imaginary line intersects the striking face 18 is the CG projection, which is typically expressed as a distance above or below the center of the striking face 18. When the CG projection is well above the center of the face, impact efficiency, which is measured by COR, is not maximized. It has been discovered that a club head with a relatively lower CG projection or a CG projection located at or near the ideal impact location on the striking surface of the club face, as described more fully below, improves the impact efficiency of the golf club head as well as initial ball speed. One important ball launch parameter, namely ball spin, is also improved. The CG projection above center face of a golf club head can be measured directly, or it can be calculated from several measurable properties of the club head.

A golf club head Characteristic Time (CT) can be described as a numerical characterization of the flexibility of a golf club head striking face. The CT may also vary at points distant from the center of the striking face, but may not vary greater than approximately 20% of the CT as measured at the center of the striking face. The CT values for the golf club heads described in the present application were calculated based on the method outlined in the USGA "Procedure for Measuring the Flexibility of a Golf Clubhead," Revision 2.0, Mar. 25, 2005, which is incorporated by reference herein in its entirety. Specifically, the method described in the sections entitled "3. Summary of Method," "5. Testing Apparatus Set-up and Preparation," "6. Club Preparation and Mounting," and "7. Club Testing" are exemplary sections that are relevant. Specifically, the characteristic time is the time for the velocity to rise from 5% of a maximum velocity to 95% of the maximum velocity under the test set forth by the USGA as described above.

The coefficient of restitution (COR) of a golf club may be increased by increasing the height Hs, of the striking face 18 and/or by decreasing the thickness of the striking face 18 of a golf club head 2. However, increasing the face height may be considered undesirable because doing so will potentially cause an undesirable change to the mass properties of the golf club and to the golf club's appearance. In another embodiment the performance of the club head 2 is increased with the introduction of a channel, stress reducing feature, or boundary condition feature such as the ones disclosed in U.S. patent application Ser. Nos. 14/868,446, 14/658,267, 14/873,477, 14/939,648, 14/871,789, 14/573,701, and 14/457,883, which are incorporated herein by reference in their entirety.

Figure 11A:
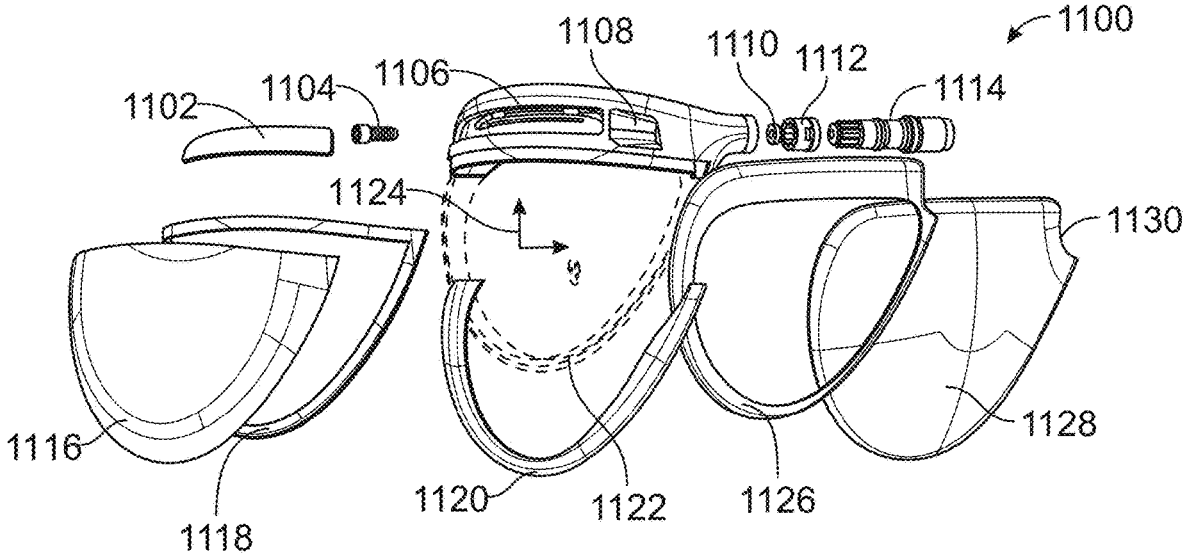
FIG. 11A is an exploded view of a golf club head according to an embodiment.

FIG. 11A illustrates an embodiment of a golf club head 1100 having components in an exploded view. FIG. 11A shows a sole channel or slot 1106, a front portion 1108, an insert 1102 that is received in the channel or slot 1106, a mechanical fastener 1104, a washer 1110, a collar 1112, a sleeve 1114, a sole portion 1116, an sole adhesive or tape layer 1118, a ring portion 1120, a center of gravity location 1124, a crown portion 1128, a hosel cutout 1130, a crown adhesive or tape layer 1126, and an intended ring location shown in phantom lines 1122. Upon assembly, the ring portion 1120 is attached to the front portion 1108 by a mechanical locking mechanism or an adhesive. The ring portion 1120 is an injection molded ring formed from a mixture of carbon fiber material and a resin material. In other embodiments, the ring portion 1120 may be made of non-metallic material, polymer material, metallic material, aluminum, magnesium, titanium, steel, tungsten or any other suitable material. The front portion 1108 is made of a titanium material such as a 9AL-1V-1Mo titanium alloy. When assembled, the ring portion is positioned in the location of the phantom lines 1122 so that the heel and toe of the ring portion 1120 is attached or connected to the front portion 1108. The sole portion 1116 is attached to both the ring portion 1120 and the front portion 1108 located on the sole side of the club by the sole adhesive 1118. The crown portion 1128 is attached to both the ring portion 1120 and the front portion 1108 located on the crown side of the club by the crown adhesive 1126. The crown portion 1128 and sole portion 1116 are comprised of a carbon fiber material and can include a unidirectional layup of carbon fibers with or without the addition of a weave layer. The ring portion 1120 in combination with the crown portion 1128 and the sole portion 1116 can be considered an aft body together. In one embodiment, the majority of the aft body by weight is made of a non-metal material while the front portion 1108 is made of a metal material. The adhesive 1126 and the crown 1130 both have a hosel cutout region that engages with the hosel of the golf club. When assembled, the adjustable sleeve 1114 is attached to a golf shaft and is also connected to the golf club head 1100 by the mechanical fastener 1104. The mechanical fastener 1104 enters an opening in the sole of the club head 1100 and is inserted into the adjustable sleeve 1114 to rigidly attached the golf club head 1100 to the shaft in various loft, lie, or face angle configurations. The collar 1112 is inserted inside the hosel bore of the golf club and secured to prevent rotation of the adjustable sleeve 1114 by engaging teeth or any other equivalent mechanical engagement surfaces such as sloped mating surfaces, splines, castellated teeth, or anti-rotation surfaces for example.

Figure 11B:
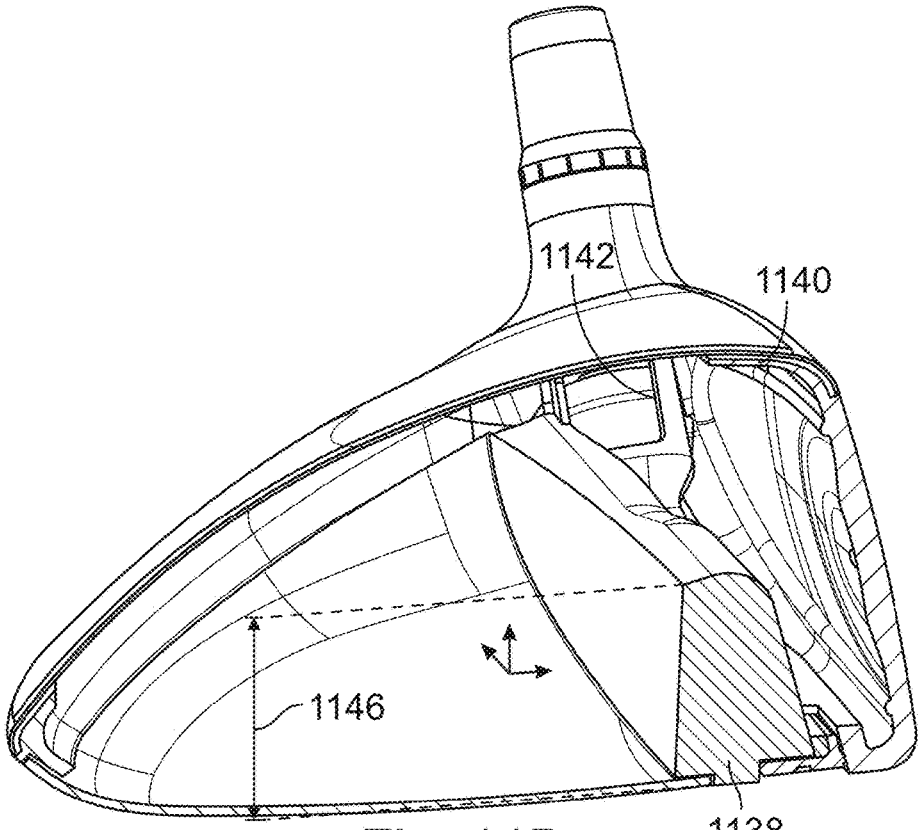
FIG. 11B is a cross-sectional view of a golf club head according to an embodiment.

FIG. 11B shows a cross-sectional view of the golf club head 1100 taken in the Z-Y plane through center face and the golf club head 1100 having a front opening to receive a face insert. The face insert is made of titanium but could be made of steel, magnesium, aluminum, or other known metals. Located behind the face insert is a wall portion 1138 having a front wall facing the face insert, a top wall, and a rear wall facing away from the face insert. In one embodiment, the wall portion 1138 is a condensed mass of material made of the same material as the front portion 1108. In other embodiments, the wall portion 1138 may be a different material of higher or lower density relative to the front portion 1108 that is welded, mechanically fastened, or bonded to the front portion 1108. In one embodiment, the wall portion is made from titanium, steel, magnesium, tungsten, aluminum, copper, bronze, or any material having a higher density than 4.5 g/cc, in the range of 4.5 g/cc to 50 g/cc, or in the range of 5 g/cc to 20 g/cc.

Front portion 1108 has a crown attachment surface 1140, a hosel interior window 1142, and a wall portion 1138. The wall portion 1138, in all the embodiments described herein, is not limited to a flat wall-like feature but may have various geometric shapes such as ovals, triangles, squares, rectangles, or complex geometries that are non-uniform with features protruding from the wall portion 1138. In one embodiment, the crown attachment surface 1140 extends all the way to the face insert opening 1138 so that the crown and the face insert are directly adjacent to one another and are separated by a small gap of less than 1 mm. In one embodiment, the front wall portion 1138 has a front wall height 1146 measured in a front-to-back Z-Y plane through center face when the club is oriented at the address position. The wall height is measured as the maximum height of the front wall portion 1138 in a Z-direction as measured from the outer sole surface of the club head in any Z-Y plane, not necessarily a plane taken through center face. For ease of illustration, the embodiments shown herein have a maximum wall height in the center face plane, but it is understood that the maximum wall height may occur toward the toe or heel in other embodiments. The wall height is between 10 mm and 40 mm, or more preferably between 15 mm and 30 mm. In one embodiment the mass of the wall portion 1138 is between 30 g to 140 g, between 40 g to 120 g, or between 50 g and 90 g. The unique head properties of the golf club head 1100 are shown in as Embodiment #1 in Table 1 below.

Figure 12A:
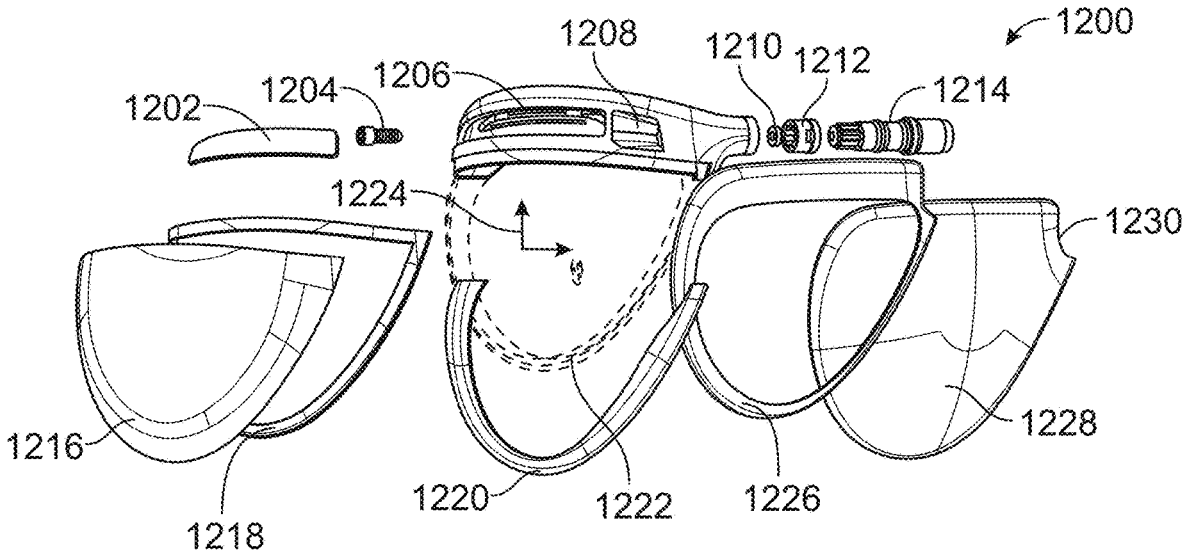
FIG. 12A is an exploded view of a golf club head according to an embodiment.
Figure 12B:
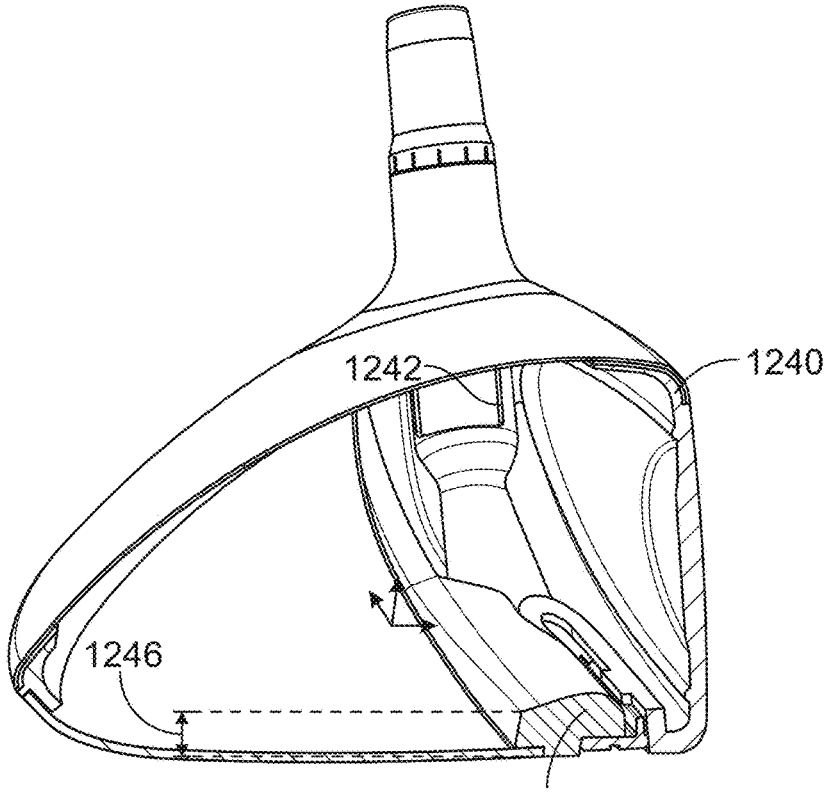
FIG. 12B is a cross-sectional view of a golf club head according to an embodiment.

In another embodiment, FIGS. 12A and 12B show a golf club head 1200 having a similar construction to the golf club head 1100 illustrated in FIGS. 11A-11B. However, the front portion 1208 in FIG. 12A is made of a steel material having a density in the range of 7.5 g/cm$^3$ to 8.1 g/cm$^3$ or about 7.8 g/cm$^3$. The golf club head 1200 includes a sole channel or slot 1206, a face insert (shown FIG. 12B), a front portion 1208, an insert 1202 that is received in the channel or slot 1206, a mechanical fastener 1204, a washer 1210, a collar 1212, a sleeve 1214, a sole portion 1216, an sole adhesive or tape layer 1218, a ring portion 1220, a center of gravity location 1224, a crown portion 1228, a hosel cutout 1230, a crown adhesive or tape layer 1226, and an intended ring location shown in phantom lines 1222. Due to the higher density front portion 208, the D1 value of the golf club head 1200 in FIG. 12A and FIG. 12B is significantly lower or closer to the hosel plane of the golf club indicating a more forward center of gravity location thereby providing a lower moment of inertia and lower spin trajectory while maintaining a head shape that conforms to the USGA rules and volume greater than 300 cm$^3$ but less than 450 cm$^3$. The embodiment in FIGS. 12A and 12B is shown as embodiment #2 in Table 1 below. In some embodiments, the volume could be 250 cm$^3$ to 400 cm$^3$ or 275 cm$^3$ to 350 cm$^3$.

In FIG. 12B, a wall height 1246 of wall portion 1238 is between 5 mm and 30 mm, or more preferably between 10 mm and 25 mm. In one embodiment the mass of the wall portion 1238 is between 5 g to 140 g, between 10 g to 100 g, or between 20 g and 90 g.

Figure 13A:
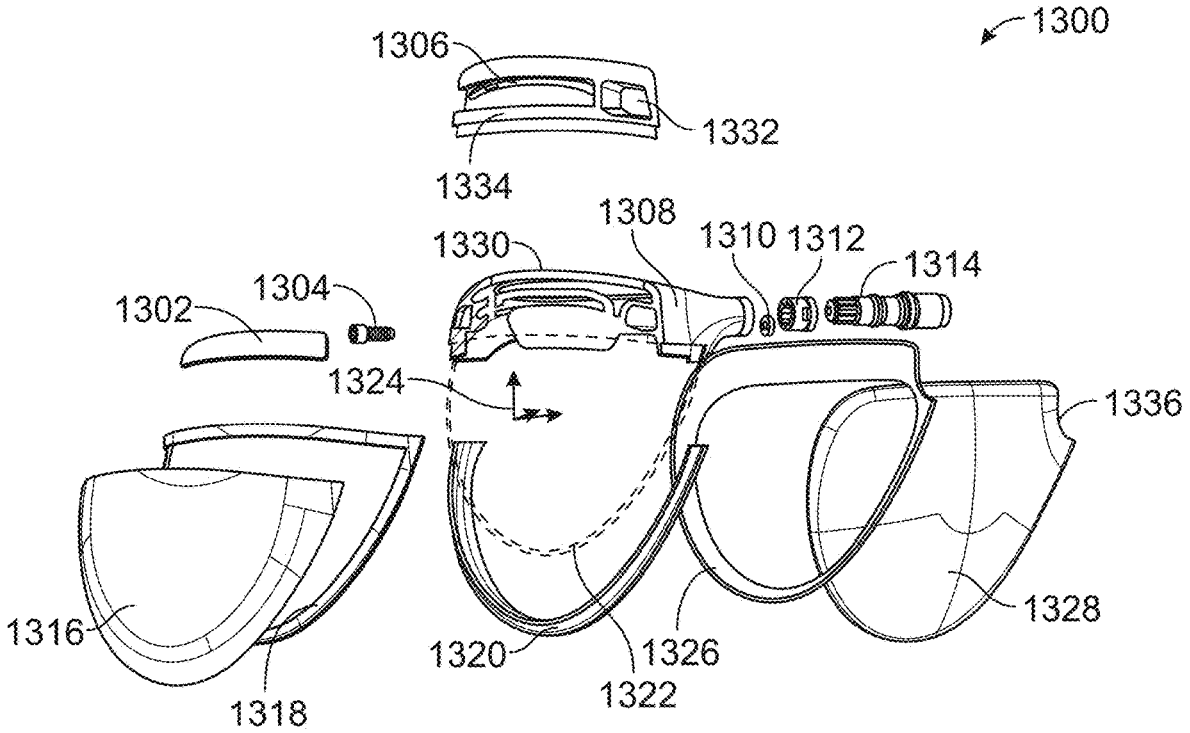
FIG. 13A is an exploded view of a golf club head according to an embodiment.
Figure 13B:
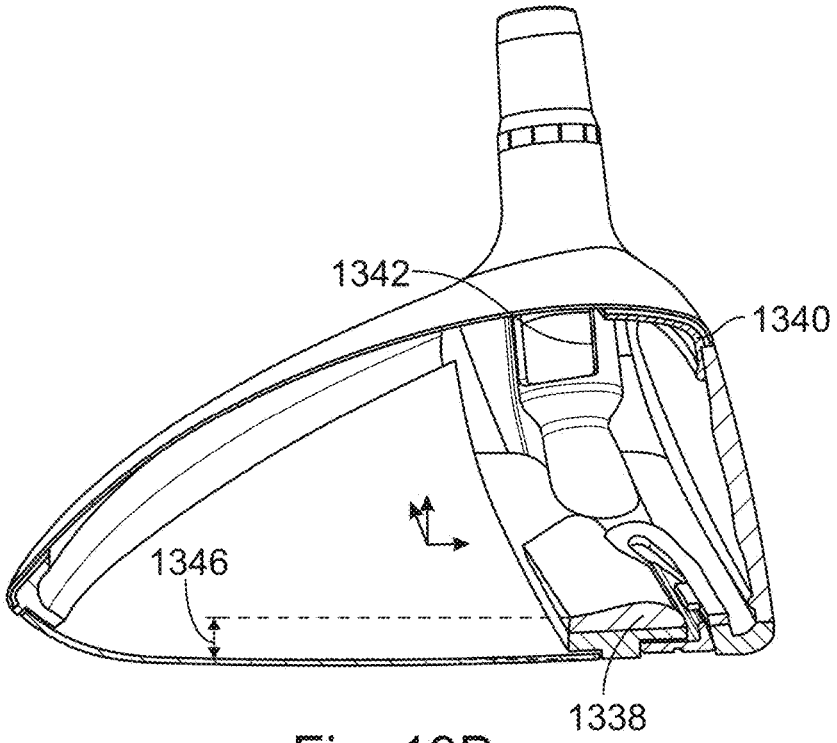
FIG. 13B is a cross-sectional view of a golf club head according to an embodiment.

In another embodiment, FIGS. 13A and 13B show a golf club head 1300 having a unique construction having a multiple piece front portion made of an upper front portion 1308 and lower front portion 1334. The upper front portion 1308 is made from a titanium alloy, such as Ti 9Al-1V-1Mo, while the lower front portion 1334 is made from a high density material, such as tungsten, having a higher density than the upper front portion 1308. Although a tungsten material having a density greater than 7.8 g/cm$^3$ was used, any similar material having a density range such as 10 g/cm$^3$ to 25 g/cm$^3$ or between 7.8 g/cm$^3$ and 50 g/cm$^3$, can be utilized for the lower front portion 1334. Other high density metals such as tungsten alloys, steel alloys, magnesium alloys, or any material having a density greater than 4.5 g/cm$^3$ can be utilized.

In FIG. 13A, the golf club head 1300 includes a sole channel or slot 1306, a hosel attachment opening 1332, a face insert 1330, an upper front portion 1308, a lower front portion 1334, an insert 1302 that is received in the channel or slot 1306, a mechanical fastener 1304, a washer 1310, a collar 1312, a sleeve 1314, a sole portion 1316, an sole adhesive or tape layer 1318, a ring portion 1320, a center of gravity location 1324, a crown portion 1328, a hosel cutout 1336, a crown adhesive or tape layer 1326, and an intended ring location shown in phantom lines 1322. Due to the higher density lower front portion 1334, the Zup value of the golf club head 1300 in FIGS. 13A and 13B is significantly lower or closer to the ground plane of the golf club indicating a more low and forward center of gravity location thereby providing a lower moment of inertia and lower spin trajectory while maintaining a head shape that conforms to the USGA rules and volume greater than 300 cm$^3$ but less than 450 cm$^3$. The embodiment in FIGS. 13A and 13B is shown as embodiment #3 in Table 1 below. In some embodiments, the volume could be 250 cm$^3$ to 400 cm$^3$ or 275 cm$^3$ to 350 cm$^3$.

FIG. 13B shows a cross-sectional view of the golf club head 1300. Front portion 1308 has a crown attachment surface 1340, a hosel interior window 1342, and a wall portion 1338. In one embodiment, the crown attachment surface 1340 extends all the way to the face insert 1330 so that the crown 1328 and the face insert 1330 are directly adjacent to one another and are separated by a small gap of less than 1 mm, or less than 6 mm. In one embodiment, the front wall portion 1338 is composed of, at least partially, the lower front portion 1334 having a front wall height 1346 measured in a front-to-back Z-Y plane through center face when the club is oriented at the address position. The wall height is between 5 mm and 30 mm, or more preferably between 10 mm and 25 mm. In one embodiment the amount of mass located in the wall portion 1338 is between 5 g to 140 g, between 10 g to 100 g, or between 20 g and 90 g. As defined for every embodiment herein, the "mass of the wall portion" 1338 is determined by modeling a golf club having a uniform sole thickness of 1 mm in the region where the wall portion 1338 would have been attached. The total wall portion 1338 mass is equal to the total mass of the club head 1300 including the wall portion 1338 minus the total club head mass of a hypothetical model having the exact same dimensions and materials but replacing the wall portion 1338 with a 1 mm hypothetical sole thickness as if the front wall portion 1338 were not present in the golf club head 1300 while maintaining a USGA legal golf club head.

Figure 14A:
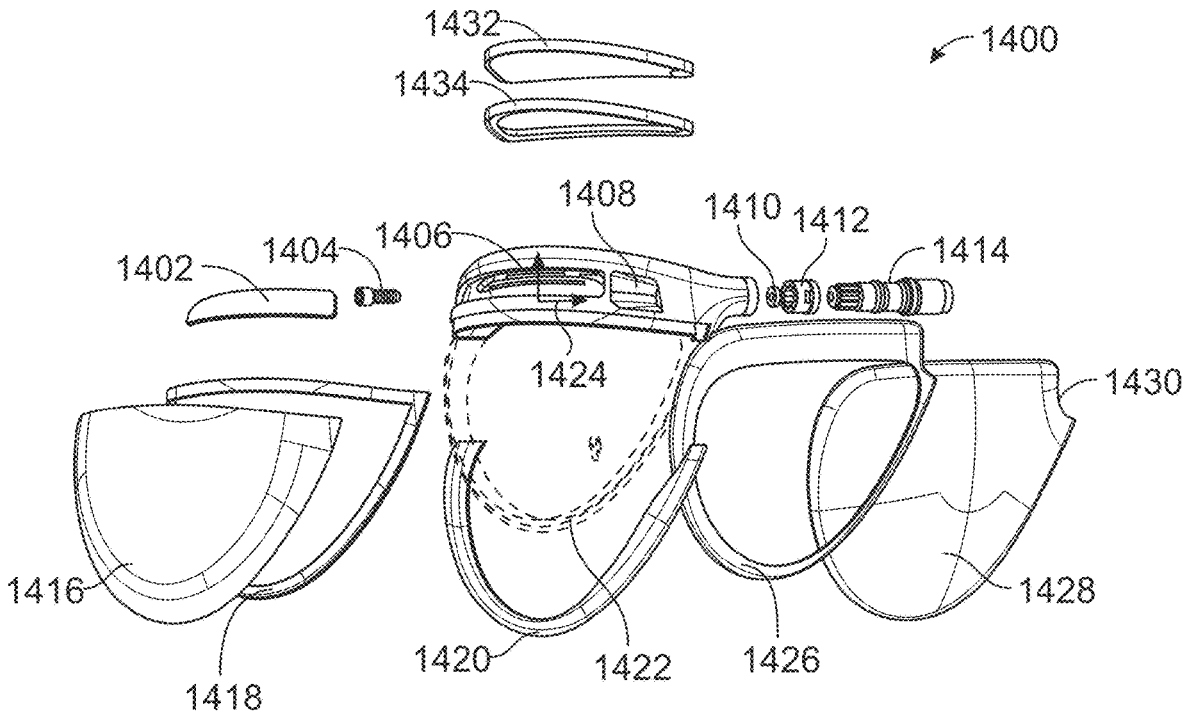
FIG. 14A is an exploded view of a golf club head according to an embodiment.
Figure 14B:
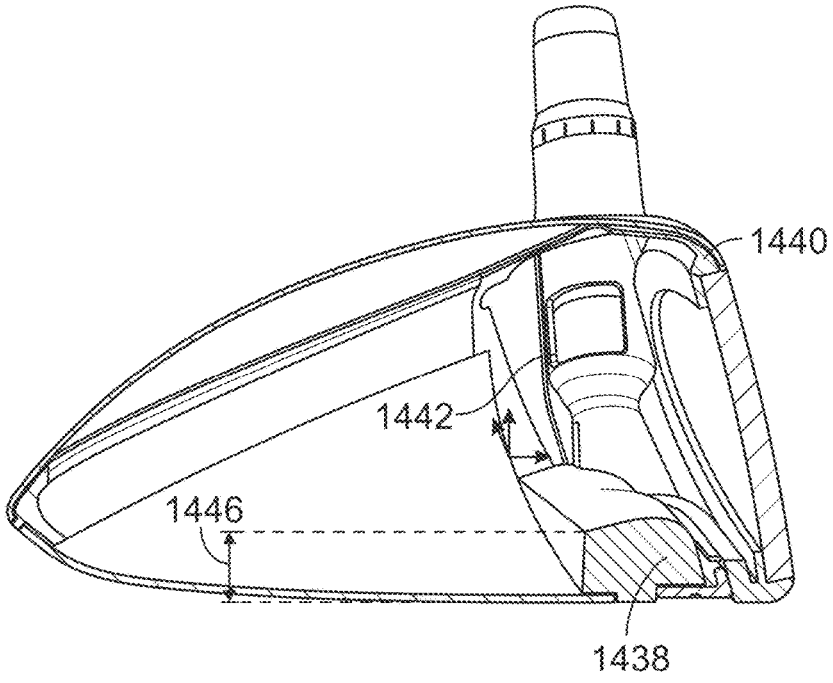
FIG. 14B is a cross-sectional view of a golf club head according to an embodiment.

In another embodiment, FIGS. 14A and 14B show a golf club head 1400 having a unique construction having a front portion made of steel. The upper front portion 1408 is made from a steel alloy, such as stainless steel, carbon steel, or maraging steel. Although a steel material having a density of about 7.8 g/cm$^3$ was used, any similar material having a density range such as 7.72 g/cm$^3$ to 8.05 g/cm$^3$ or between 7.8 g/cm$^3$ and 8.02 g/cm$^3$, can be utilized for the front portion 1408.

In FIG. 14A, the golf club head 1400 includes a sole channel or slot 1406, a carbon fiber face insert 1432, a face insert adhesive 1434, a front portion 1408, an sole insert 1402 that is received in the channel or slot 1406, a mechanical fastener 1404, a washer 1410, a collar 1412, a sleeve 1414, a sole portion 1416, an sole adhesive or tape layer 1418, a ring portion 1420, a center of gravity location 1424, a crown portion 1428, a hosel cutout 1430, a crown adhesive or tape layer 1426, and an intended ring location shown in phantom lines 1422. Due to the higher density front portion 1408, the Zup value of the golf club head 1400 in FIGS. 14A and 14B is significantly lower or closer to the ground plane of the golf club indicating a more low and forward center of gravity location thereby providing a lower moment of inertia and lower spin trajectory while maintaining a head shape that conforms to the USGA rules and volume greater than 300 cm$^3$ but less than 450 cm$^3$. The embodiment in FIGS. 14A and 14B is shown as embodiment #4 in Table 1 below. In some embodiments, the volume could be 250 cm$^3$ to 400 cm$^3$ or 275 cm$^3$ to 350 cm$^3$.

FIGS. 14A and 14B also show a composite face insert 1432 and a composite face insert adhesive 1434 that attaches the composite face insert 1432 to the front portion 1408. The composite face insert 1432 utilizes the same processes and geometry described in U.S. patent application Ser. Nos. 14/210,000, 14/184,585, and 14/154,513 which have already been incorporated by reference in their entirety herein.

FIG. 14B shows a cross-sectional view of the golf club head 1400. Front portion 1408 has a crown attachment surface 1440 that extends all the way to the face, a hosel interior window 1442, and a wall portion 1438. In one embodiment, the crown attachment surface 1440 extends all the way to be adjacent the face insert 1432 so that the crown 1428 and the face insert 1432 are directly adjacent to one another and are separated by a small gap of less than 1 mm, or less than 6 mm. In one embodiment, the front wall portion 1438 has a wall height 1446 that is between 5 mm and 30 mm, or more preferably between 10 mm and 25 mm. In one embodiment the amount of mass located in the wall portion 1438 is between 5 g to 140 g, between 10 g to 100 g, or between 20 g and 90 g.

Figure 15A:
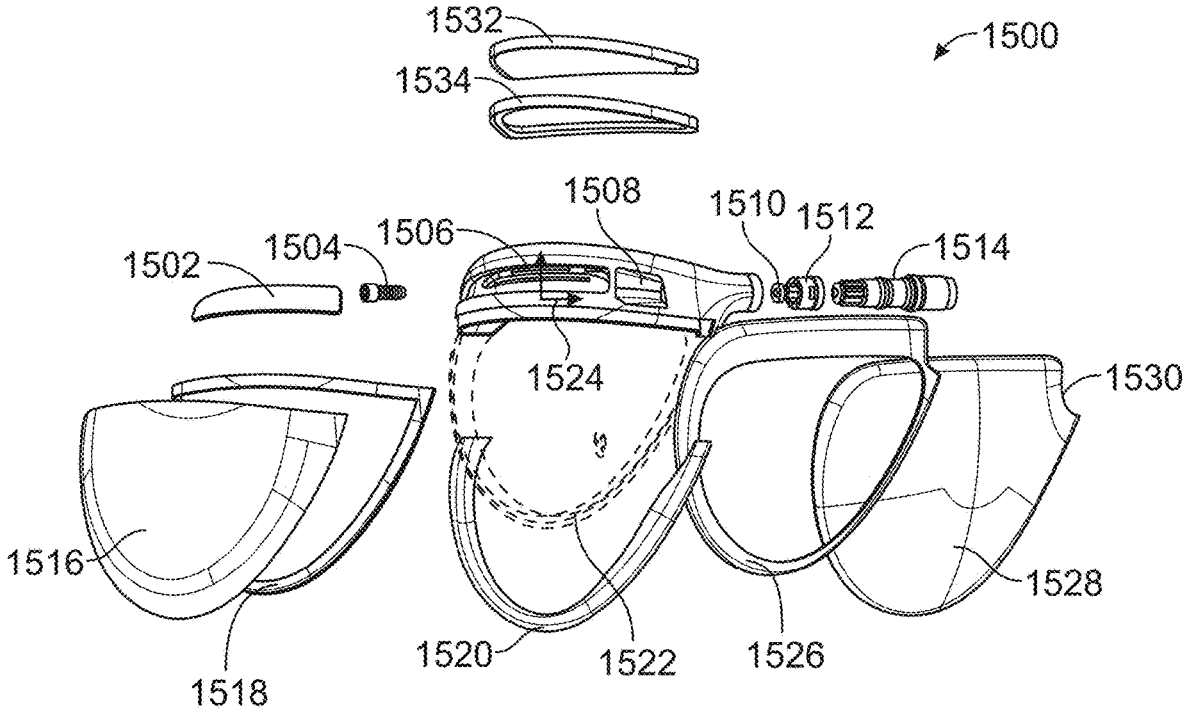
FIG. 15A is an exploded view of a golf club head according to an embodiment.
Figure 15B:
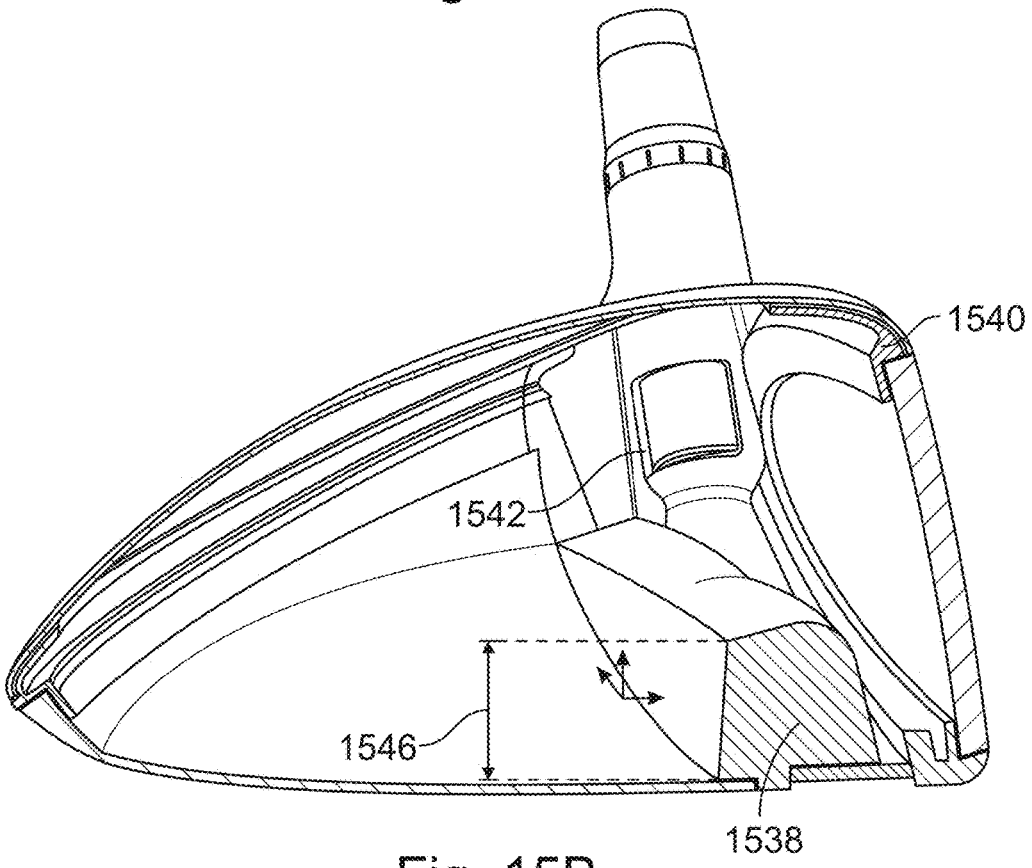
FIG. 15B is a cross-sectional view of a golf club head according to an embodiment.

In another embodiment, FIGS. 15A and 15B show a golf club head 1500 having a unique construction having a front portion made of steel. The front portion 1508 is made from a titanium alloy, such as Ti-9AL-1MO-1V. Although a titanium material having a density of about 4.5 g/cm$^3$ was used, any similar material having a density range such as 4.1 g/cm$^3$ to 4.9 g/cm$^3$ or between 4.3 g/cm$^3$ and 4.7 g/cm$^3$, can be utilized for the front portion 1508 and still have similar head properties.

In FIG. 15A, the golf club head 1500 includes a sole channel or slot 1506, a carbon fiber face insert 1532, a face insert adhesive 1534, a front portion 1508, an sole insert 1502 that is received in the channel or slot 1506, a mechanical fastener 1504, a washer 1510, a collar 1512, a sleeve 1514, a sole portion 1516, an sole adhesive or tape layer 1518, a ring portion 1520, a center of gravity location 1524, a crown portion 1528, a hosel cutout 1530, a crown adhesive or tape layer 1526, and an intended ring location shown in phantom lines 1522. Due to the higher density front portion 1508, the Zup value of the golf club head 1500 in FIGS. 15A and 15B is significantly lower or closer to the ground plane of the golf club indicating a more low and forward center of gravity location thereby providing a lower moment of inertia and lower spin trajectory while maintaining a head shape that conforms to the USGA rules and volume greater than 300 cm$^3$ but less than 450 cm$^3$. The embodiment in FIGS. 15A and 15B is shown as embodiment #5 in Table 1 below. In some embodiments, the volume could be 250 cm$^3$ to 420 cm$^3$ or 350 cm$^3$ to 425 cm$^3$.

FIGS. 15A and 15B also show a composite face insert 1532 and a composite face insert adhesive 1534 that attaches the composite face insert 1532 to the front portion 1508. The composite face insert 1532 utilizes the same processes and geometry described in U.S. patent application Ser. Nos. 14/210,000, 14/184,585, and 14/154,513 which have already been incorporated by reference in their entirety herein.

FIG. 15B shows a cross-sectional view of the golf club head 1500. Front portion 1508 has a crown attachment surface 1540 that extends all the way to the face, a hosel interior window 1542, and a wall portion 1538. In one embodiment, the crown attachment surface 1540 extends all the way to be adjacent the face insert 1532 so that the crown 1528 and the face insert 1532 are directly adjacent to one another and are separated by a small gap of less than 1 mm, or less than 6 mm. In one embodiment, the front wall portion 1538 has a wall height 1546 that is between 5 mm and 40 mm, or more preferably between 10 mm and 40 mm. In one embodiment the amount of mass located in the wall portion 1538 is between 5 g to 140 g, between 10 g to 100 g, or between 20 g and 90 g.

Figure 16A:
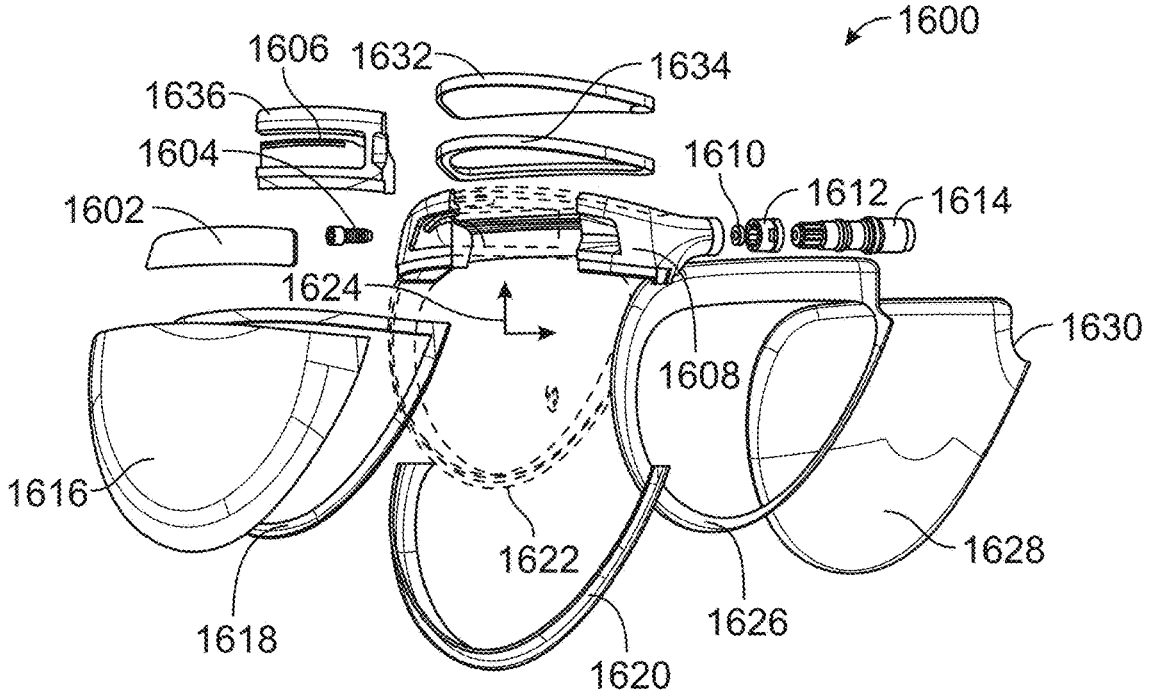
FIG. 16A is an exploded view of a golf club head according to an embodiment.
Figure 16B:
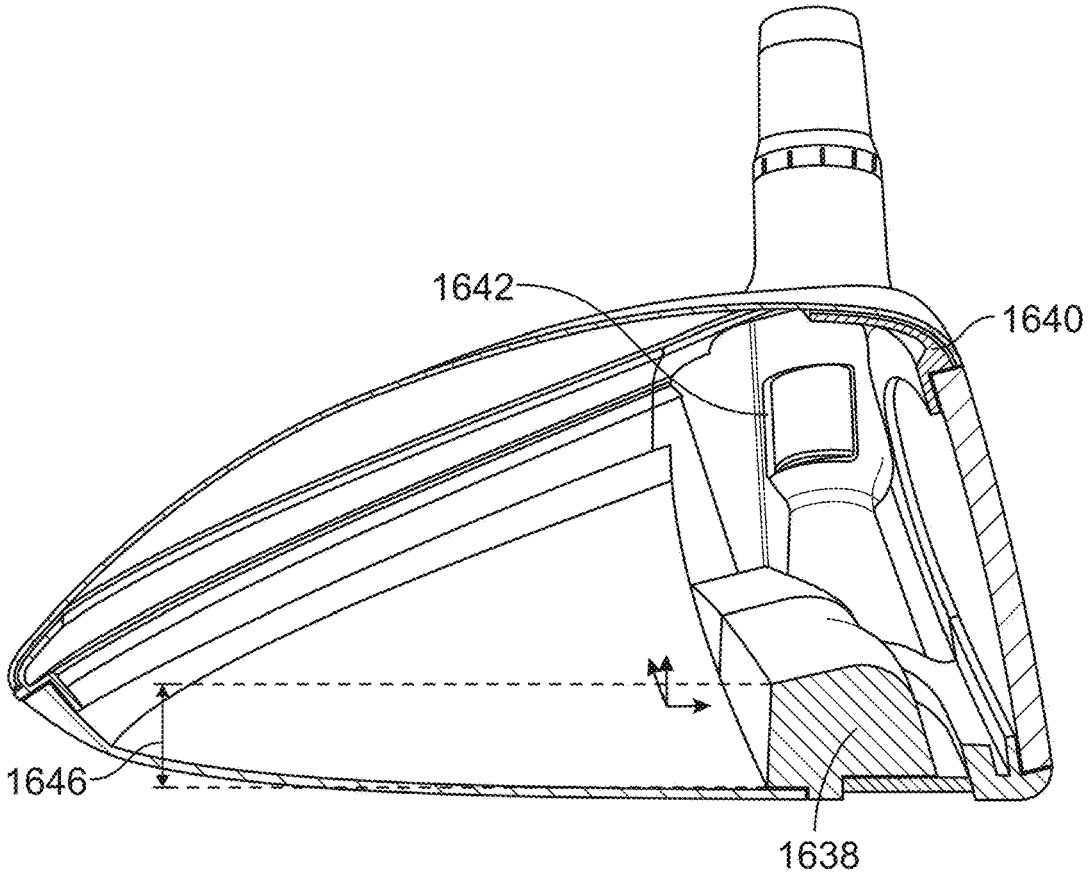
FIG. 16B is a cross-sectional view of a golf club head according to an embodiment.

In another embodiment, FIGS. 16A and 16B show a golf club head 1600 having a unique construction having an upper front portion 1608 made of aluminum and a lower front portion 1636 made of steel. The upper front portion 1608 is made from a aluminum alloy having a density of about 2.7 g/cm$^3$ was used, any similar material having a density range such as 2.3 g/cm$^3$ to 4.1 g/cm$^3$ or between 2.5 g/cm$^3$ and 2.9 g/cm$^3$, can be utilized for the upper front portion 1608 and still have similar head properties. The lower front portion 1636 is made from a steel having a density of about 7.8 g/cm$^3$ or any similar material having a density range such as 7.72 g/cm$^3$ to 8.05 g/cm$^3$ or between 7.8 g/cm$^3$ and 8.02 g/cm$^3$.

In FIG. 16A, the golf club head 1600 includes a sole channel or slot 1606, a carbon fiber face insert 1632, a face insert adhesive 1634, a upper front portion 1608, lower front portion 1636, an sole insert 1602 that is received in the channel or slot 1606, a mechanical fastener 1604, a washer 1610, a collar 1612, a sleeve 1614, a sole portion 1616, an sole adhesive or tape layer 1618, a ring portion 1620, a center of gravity location 1624, a crown portion 1628, a hosel cutout 1630, a crown adhesive or tape layer 1626, and an intended ring location shown in phantom lines 1622. Due to the higher density front portion 1608, the Zup value of the golf club head 1600 in FIGS. 16A and 16B is significantly lower or closer to the ground plane of the golf club indicating a more low and forward center of gravity location thereby providing a lower moment of inertia and lower spin trajectory while maintaining a head shape that conforms to the USGA rules and volume greater than 300 cm$^3$ but less than 450 cm$^3$. The embodiment in FIGS. 16A and 16B is shown as embodiment #6 in Table 1 below. In some embodiments, the volume could be 250 cm$^3$ to 420 cm$^3$ or 350 cm$^3$ to 425 cm$^3$.

FIGS. 16A and 16B also show a composite face insert 1632 and a composite face insert adhesive 1634 that attaches the composite face insert 1632 to the front portion 1608. The composite face insert 1632 utilizes the same processes and geometry described in U.S. patent application Ser. Nos. 14/210,000, 14/184,585, and 14/154,513 which have already been incorporated by reference in their entirety herein.

FIG. 16B shows a cross-sectional view of the golf club head 1600. Front portion 1608 has a crown attachment surface 1640 that extends all the way to the face, a hosel interior window 1642, and a wall portion 1638. In one embodiment, the crown attachment surface 1640 extends all the way to be adjacent the face insert 1632 so that the crown 1628 and the face insert 1632 are directly adjacent to one another and are separated by a small gap of less than 1 mm, or less than 6 mm. In one embodiment, the front wall portion 1638 has a wall height 1646 that is between 5 mm and 40 mm, or more preferably between 10 mm and 40 mm. In one embodiment the amount of mass located in the wall portion 1638 is between 5 g to 140 g, between 10 g to 100 g, or between 20 g and 90 g.

Figure 17A:
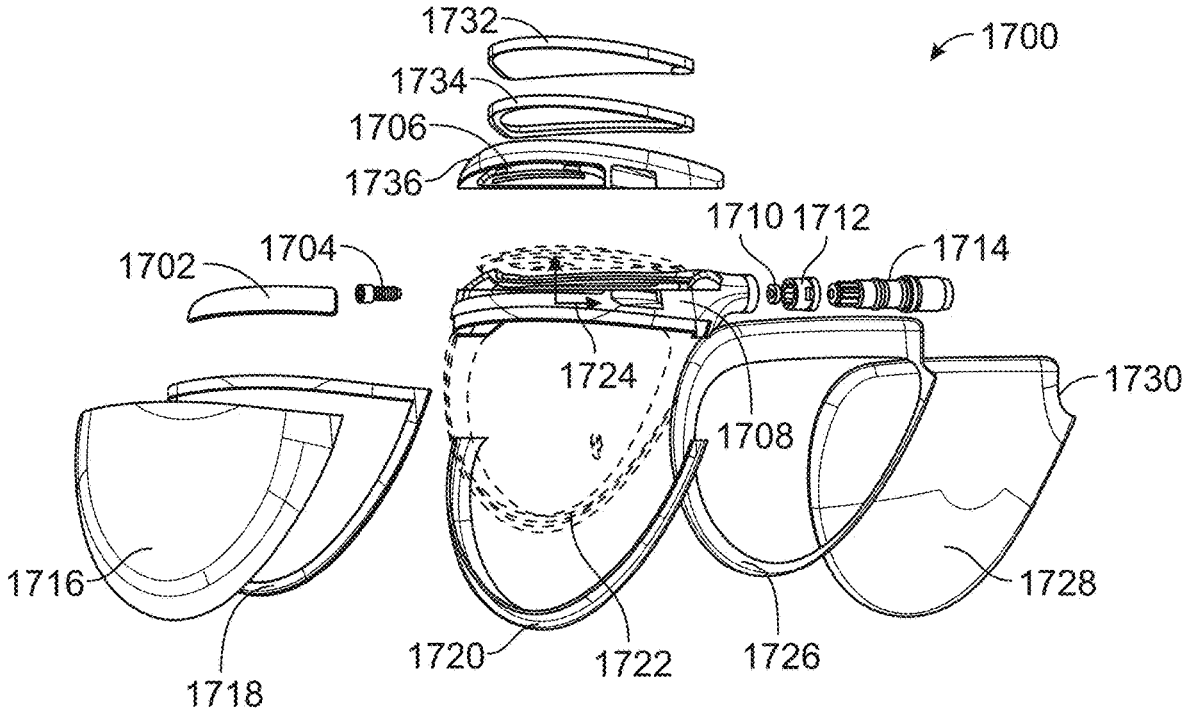
FIG. 17A is an exploded view of a golf club head according to an embodiment.
Figure 17B:
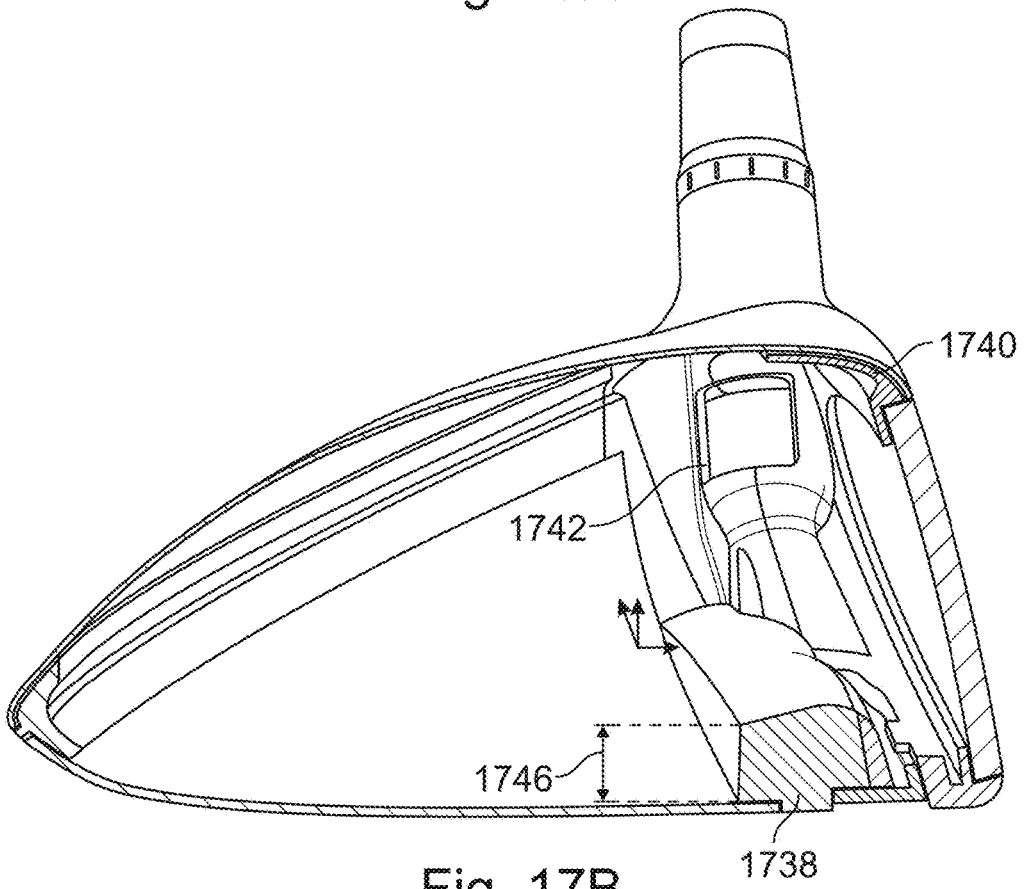
FIG. 17B is a cross-sectional view of a golf club head according to an embodiment.

In another embodiment, FIGS. 17A and 17B show a golf club head 1700 having a unique construction having an upper front portion 1708 made of aluminum and a lower front portion 1736 made of steel. The upper front portion 1708 is made from a aluminum alloy having a density of about 2.7 g/cm$^3$ was used, any similar material having a density range such as 2.3 g/cm$^3$ to 4.1 g/cm$^3$ or between 2.5 g/cm$^3$ and 2.9 g/cm$^3$, can be utilized for the upper front portion 1708 and still have similar head properties. The lower front portion 1736 is made from a tungsten having a density of about 17 g/cm$^3$ or any similar material having a density range such as 14 g/cm$^3$ to 20 g/cm$^3$ or between 16 g/cm$^3$ and 18 g/cm$^3$.

In FIG. 17A, the golf club head 1700 includes a sole channel or slot 1706, a carbon fiber face insert 1732, a face insert adhesive 1734, a upper front portion 1708, lower front portion 1736, an sole insert 1702 that is received in the channel or slot 1706, a mechanical fastener 1704, a washer 1710, a collar 1712, a sleeve 1714, a sole portion 1716, an sole adhesive or tape layer 1718, a ring portion 1720, a center of gravity location 1724, a crown portion 1728, a hosel cutout 1730, a crown adhesive or tape layer 1726, and an intended ring location shown in phantom lines 1722. Due to the higher density front portion 1708, the Zup value of the golf club head 1700 in FIGS. 17A and 17B is significantly lower or closer to the ground plane of the golf club indicating a more low and forward center of gravity location thereby providing a lower moment of inertia and lower spin trajectory while maintaining a head shape that conforms to the USGA rules and volume greater than 300 cm$^3$ but less than 450 cm$^3$. The embodiment in FIGS. 17A and 17B is shown as embodiment #7 in Table 1 below. In some embodiments, the volume could be 250 cm$^3$ to 420 cm$^3$ or 350 cm$^3$ to 425 cm$^3$.

FIGS. 17A and 17B also show a composite face insert 1732 and a composite face insert adhesive 1734 that attaches the composite face insert 1732 to the front portion 1708. The composite face insert 1732 utilizes the same processes and geometry described in U.S. patent application Ser. Nos. 14/210,000, 14/184,585, and 14/154,513 which have already been incorporated by reference in their entirety herein.

FIG. 17B shows a cross-sectional view of the golf club head 1700. Upper front portion 1708 has a crown attachment surface 1740 that extends all the way to the face, a hosel interior window 1742, and a wall portion 1738. In one embodiment, the crown attachment surface 1740 extends all the way to be adjacent the face insert 1732 so that the crown 1728 and the face insert 1732 are directly adjacent to one another and are separated by a small gap of less than 1 mm, or less than 6 mm. In one embodiment, the front wall portion 1738 has a wall height 1746 that is between 5 mm and 40 mm, or more preferably between 10 mm and 40 mm. In one embodiment the amount of mass located in the wall portion 1738 is between 5 g to 140 g, between 10 g to 100 g, or between 20 g and 90 g.

The ring portions in the embodiments in Table 1 utilize an injection molded composite ring for the ring portions described above, the ring portion having a density lower than 4.4 g/cc and made of carbon fibers and resin in order to promote the most forward CG possible.

TABLE 1

| Embodiment | #1 | #2 | #3 | #4 | #5 | #6 | #7 |
|---|---|---|---|---|---|---|---|
| Loft (degrees) | 13.5 | 13.5 | 13.5 | 13.5 | 13.5 | 13.5 | 13.5 |
| Volume (cc) | 312 | 312 | 312 | 312 | 400 | 400 | 312 |
| CGX (mm) | 1.4 | 3.2 | 2.3 | 2.1 | 1.7 | 2.5 | 1.8 |
| CGZ (mm) | −6.3 | −4.9 | −9.9 | −6 | −7.2 | −10.1 | −7.6 |
| CGY (mm) | 18.7 | 15.3 | 15.8 | 18.7 | 22.2 | 21.8 | 15.8 |
| Delta 1 (mm) or D1 | 4.8 | 1.4 | 1.9 | 4.8 | 7.7 | 7.3 | 1.9 |
| Delta 2 (mm) or D2 | 30.8 | 30.1 | 27.9 | 30.3 | 33 | 30.7 | 29.7 |
| Delta 3 (mm) or D3 | 69.8 | 67.6 | 72.2 | 69.1 | 74.6 | 76.6 | 70.6 |
| CFY (mm) | 13.9 | 13.9 | 13.9 | 13.9 | 14.5 | 14.5 | 13.9 |
| Mass (g) | 200 | 201.6 | 198.5 | 197.7 | 196.7 | 197 | 198.4 |
| Ixx (kg · mm$^2$) | 109 | 120 | 125 | 129 | 153 | 185 | 138 |
| Iyy (kg · mm$^2$) | 211 | 242 | 216 | 245 | 261 | 242 | 252 |
| Izz (kg · mm$^2$) | 255 | 278 | 247 | 282 | 312 | 279 | 311 |
| BP Proj. Up (mm) | 23.87 | 24.45 | 19.79 | 24.18 | 22.76 | 5.19 | 22.01 |
| BP Proj. (mm) | −1.77 | −1.18 | −5.97 | −1.45 | −1.8 | −4.75 | −3.68 |
| Zup (mm) | 18.9 | 20.4 | 15.3 | 19.2 | 20.1 | 17.2 | 17.7 |
| D1*Izz/Volume (kg · mm$^3$)/cm$^3$ | 3.9 | 1.2 | 1.5 | 4.3 | 6.0 | 5.1 | 1.9 |
| D1*Iyy/Volume (kg · mm$^3$)/cm$^3$ | 3.2 | 1.1 | 1.3 | 3.8 | 5.0 | 4.4 | 1.5 |
| D1*Ixx/Volume (kg · mm$^3$)/cm$^3$ | 1.7 | 0.5 | 0.8 | 2.0 | 2.9 | 3.4 | 0.8 |
| D1*Izz*Ixx/Volume (kg$^2$ · mm$^5$)/cm$^3$ | 427.6 | 149.7 | 188.0 | 559.7 | 918.9 | 942.0 | 261.4 |
| D1*Izz*Ixx*Iyy/Volume (kg$^3$ · mm$^7$)/cm$^3$ | 90,226.8 | 36,225.5 | 40,612.5 | 137,117.1 | 239,837.6 | 227,957.6 | 65,862.6 |
| Head Width (mm) | 111.8 | 111.8 | 111.8 | 111.8 | 118.9 | 118.9 | 111.8 |
| Head Height (mm) | 52.3 | 52.3 | 52.3 | 52.3 | 56.7 | 56.7 | 52.3 |
| Head Length (mm) | 104.6 | 104.6 | 104.6 | 104.6 | 114.3 | 114.3 | 104.6 |
| Volume/D1 (cc/mm) | 65.0 | 222.9 | 164.2 | 65.0 | 51.9 | 54.8 | 164.2 |
| Volume/Zup (cc/mm) | 16.5 | 15.3 | 20.4 | 16.3 | 19.9 | 23.3 | 17.6 |
| Zup/D1 (mm/mm) | 3.9 | 14.6 | 8.1 | 4.0 | 2.6 | 2.4 | 9.3 |
| Volume/Zup/D1 (cc) | 79.2 | 21.4 | 38.7 | 78.0 | 153.2 | 169.8 | 33.5 |

Table 1 shows the golf club head properties of the seven embodiments described in FIGS. 11A to 17B, respectively.

The embodiments of Table 1 have a loft between 8° and 14°, a volume between 290 cc and 460 cc, or more preferably a volume between 300 cc and 420 cc. The embodiments of Table 1 have a CGX of between 0 mm and 4 mm or between 1 mm and 3.5 mm. The embodiments of Table 1 have a CGZ of between 0 mm and −11 mm or between −4 mm and −10.5 mm. The embodiments of Table 1 have a CGY of between 15 mm and 23 mm or between 15 mm and 22.5 mm. The embodiments of Table 1 have a Delta1 of between 1 mm and 10 mm or between 1 mm and 8 mm. The embodiments of Table 1 have a Delta2 of between 25 mm and 35 mm or between 28 mm and 34 mm. The embodiments of Table 1 have a Delta3 of between 65 mm and 80 mm or between 67 mm and 77 mm. The embodiments of Table 1 have a CFY of between 12 mm and 17 mm or between 13 mm and 15 mm. The embodiments of Table 1 have a mass of between 190 g and 210 g, between 190 g and 215 g, or between 195 g and 205 g.

Regarding the moments of inertia, the embodiments of Table 1 have an Ixx of between 100 kg·mm$^2$ and 200 kg·mm$^2$ or between 100 kg·mm$^2$ and 190 kg·mm$^2$. The embodiments of Table 1 have an Iyy of between 200 kg·mm$^2$ and 275 kg·mm$^2$ or between 200 kg·mm$^2$ and 265 kg·mm$^2$. The embodiments of Table 1 have an Izz of between 230 kg·mm$^2$ and 320 kg·mm$^2$ or between 250 kg·mm$^2$ and 320 kg·mm$^2$.

The embodiments of Table 1 have a BP Proj. Up of between 15 mm and 30 mm or between 17 mm and 25 mm. In addition, the embodiments of Table 1 have a BP Proj. of between −1 mm and −10 mm or between −1 mm and −7 mm. The embodiments of Table 1 have a Zup of between 10 mm and 25 mm or between 15 mm and 22 mm.

Furthermore, the embodiments of Table 1 have a Head Width, Wch, of between 100 mm and 125 mm or between 110 mm and 120 mm. The embodiments of Table 1 have a Head Height, Hch, of between 50 mm and 60 mm or between 50 mm and 57 mm. The embodiments of Table 1 have a Head Depth, Dch, (shown as Head Length in Table 1) of between 100 mm and 120 mm, between 90 mm and 130 mm, or between 100 mm and 115 mm.

Table 1 further shows a ratio of volume (cc) divided by the D1 (Delta1). The embodiments in Table 1 show a range of between 50 cc/mm to 230 cc/mm. In some embodiments the volume divided by D1 ratio is between 50 cc/mm and 70 cc/mm, between 150 cc/mm and 250 cc/mm, between 55 cc/mm and 65 cc/mm, or between 160 cc/mm and 225 cc/mm. In addition, Table 1 further shows a volume divided by Zup ratio of between 10 cc/mm and 30 cc/mm, between 12 cc/mm and 24 cc/mm, or between 14 cc/mm and 24 cc/mm. Table 1 also shows a Zup divided by D1 ratio of between 2 to 15, between 2 and 10, or between 4 and 9. Table 1 also shows a volume divided by Zup divided by D1 ratio of between 20 cc and 170 cc, between 30 cc and 80 cc, between 125 cc and 200 cc, or between 150 and 175 cc.

Figure 18:
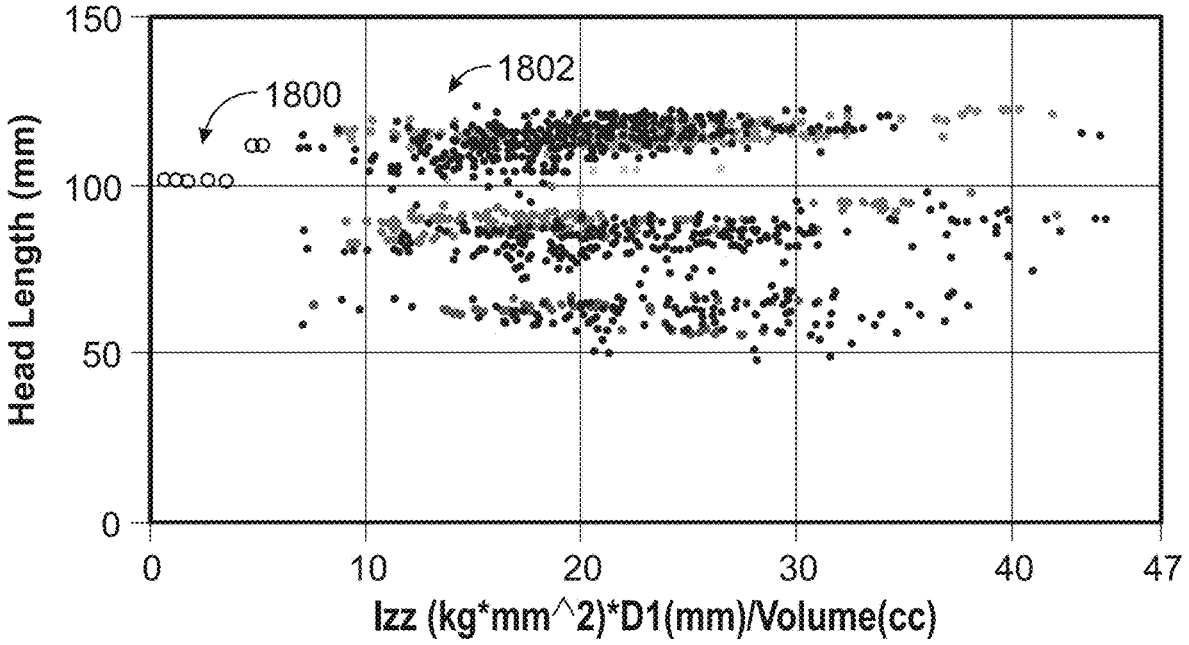
FIG. 18 is an illustrative graph.
Figure 19:
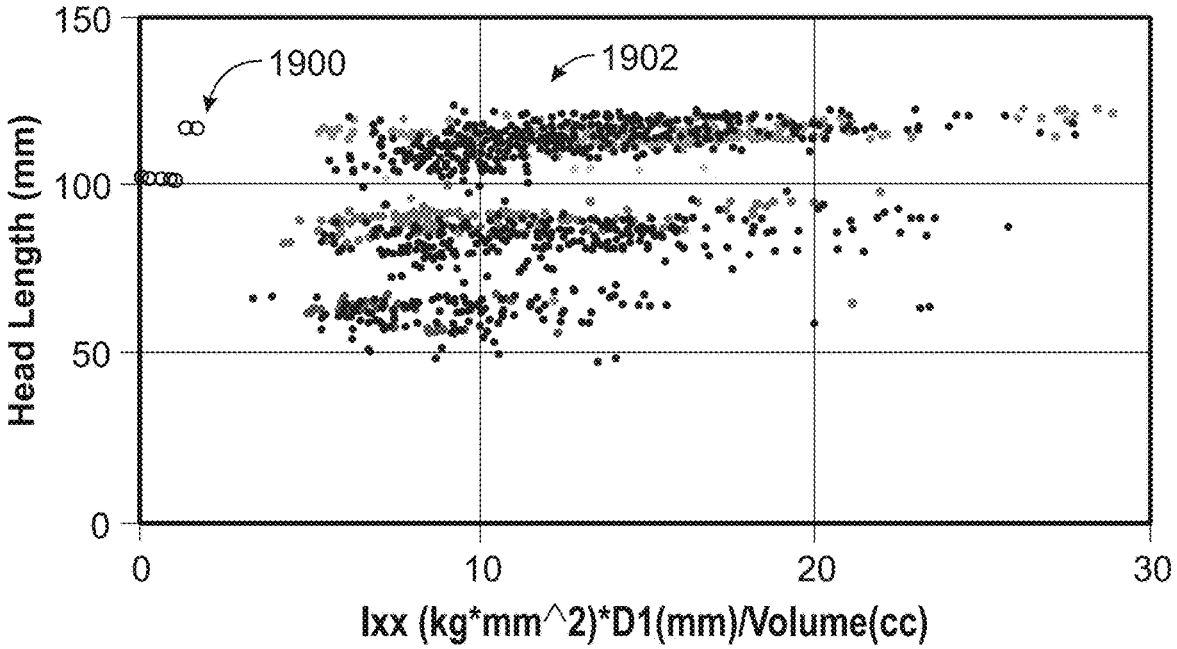
FIG. 19 is an illustrative graph.
Figure 20:
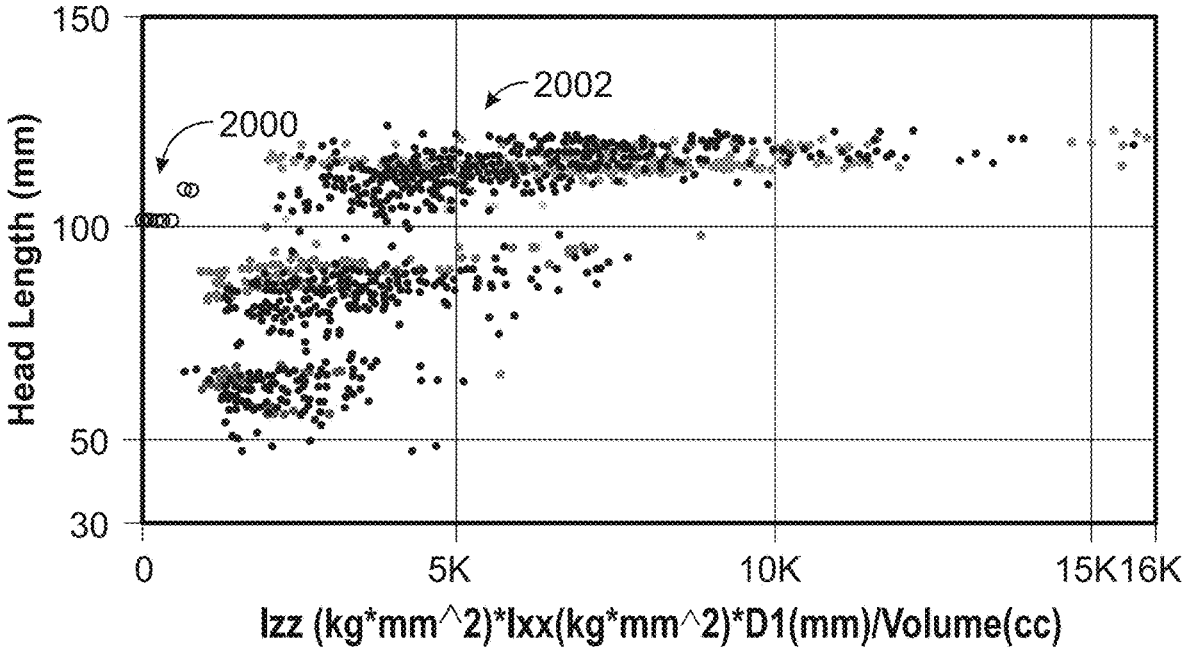
FIG. 20 is an illustrative graph.

FIGS. 18-20 show the seven embodiments described in Table 1 relative to measured head properties of golf club heads having a more traditional head designs 1802,1902, 2002. Traditional head designs 1802,1902,2002 are shown as solid filled dots. Specifically, the seven embodiments in FIGS. 18-20 are illustrated as unfilled circles shown collectively as items 1800, 1900, and 2000.

Table 1 and FIG. 18 show the seven embodiments 1800 having a specific D1z ratio defined as:

$$D1z = \frac{(D1 * Izz)}{\text{Volume}} \qquad \text{Eq. 1}$$

The seven embodiments of Table 1 have achieved a D1z ratio defined by Eq. 1 that is less than 6.3 (kg·mm$^3$)/cm$^3$. More specifically, the embodiments of Table 1 have achieved a D1z ratio of between 0.5 (kg·mm$^3$)/cm$^3$ and 6.2

$(kg \cdot mm^3)/cm^3$ or between 1 $(kg \cdot mm^3)/cm^3$ and 6.1 $(kg \cdot mm^3)/cm^3$. In some embodiments, the D1z ratio is between 1.1 $(kg \cdot mm^3)/cm^3$ and 6.0 $(kg \cdot mm^3)/cm^3$ or between 0.5 $(kg \cdot mm^3)/cm^3$ and 5 $(kg \cdot mm^3)/cm^3$. In other embodiments, the D1z ratio is between 1 $(kg \cdot mm^3)/cm^3$ and 4 $(kg \cdot mm^3)/cm^3$ or between 0.5 $(kg \cdot mm^3)/cm^3$ and 3 $(kg \cdot mm^3)/cm^3$. In yet other embodiments, the D1z ratio is between 0.5 $(kg \cdot mm^3)/cm^3$ and 2 $(kg \cdot mm^3)/cm^3$ or between 0.5 $(kg \cdot mm^3)/cm^3$ and 1.5 $(kg \cdot mm^3)/cm^3$.

Table 1 and FIG. 19 show the seven embodiments 1900 having a specific D1x ratio defined as:

$$D1x = \frac{(D1 * Ixx)}{\text{Volume}} \quad \text{Eq. 2}$$

The seven embodiments of Table 1 have achieved a D1x ratio defined by Eq. 2 that is less than 3.9 $(kg \cdot mm^3)/cm^3$. More specifically, the embodiments of Table 1 have achieved a D1x ratio of between 0.3 $(kg \cdot mm^3)/cm^3$ and 3.9 $(kg \cdot mm^3)/cm^3$ or between 0.4 $(kg \cdot mm^3)/cm^3$ and 3.8 $(kg \cdot mm^3)/cm^3$. In some embodiments, the D1x ratio is between 0.5 $(kg \cdot mm^3)/cm^3$ and 1 $(kg \cdot mm^3)/cm^3$ or between 0.5 $(kg \cdot mm^3)/cm^3$ and 3.6 $(kg \cdot mm^3)/cm^3$. In other embodiments, the D1x ratio is between 0.5 $(kg \cdot mm^3)/cm^3$ and 3.5 $(kg \cdot mm^3)/cm^3$ or between 0.5 $(kg \cdot mm^3)/cm^3$ and 3 $(kg \cdot mm^3)/cm^3$. In yet other embodiments, the D1x ratio is between 0.5 $(kg \cdot mm^3)/cm^3$ and 2.5 $(kg \cdot mm^3)/cm^3$ or between 0.5 $(kg \cdot mm^3)/cm^3$ and 2 $(kg \cdot mm^3)/cm^3$.

Table 1 and FIG. 20 show the seven embodiments 2000 having a specific D1xz ratio defined as:

$$D1xz = \frac{(D1 * Ixx * Izz)}{\text{Volume}} \quad \text{Eq. 3}$$

The seven embodiments of Table 1 have achieved a D1xz ratio defined by Eq. 3 that is less than 1400 $(kg^2 \cdot mm^5)/cm^3$. More specifically, the embodiments of Table 1 have achieved a D1xz ratio of between 100 $(kg^2 \cdot mm^5)/cm^3$ and 1300 $(kg^2 \cdot mm^5)/cm^3$ or between 125 $(kg^2 \cdot mm^5)/cm^3$ and 1200 $(kg^2 \cdot mm^5)/cm^3$. In some embodiments, the D1xz ratio is between 140 $(kg^2 \cdot mm^5)/cm^3$ and 1000 $(kg^2 \cdot mm^5)/cm^3$ or between 100 $(kg^2 \cdot mm^5)/cm^3$ and 1000 $(kg^2 \cdot mm^5)/cm^3$. In other embodiments, the D1xz ratio is between 100 $(kg^2 \cdot mm^5)/cm^3$ and 900 $(kg^2 \cdot mm^5)/cm^3$ or between 140 $(kg^2 \cdot mm^5)/cm^3$ and 800 $(kg^2 \cdot mm^5)/cm^3$. In yet other embodiments, the D1xz ratio is between 140 $(kg^2 \cdot mm^5)/cm^3$ and 700 $(kg^2 \cdot mm^5)/cm^3$ or between 145 $(kg^2 \cdot mm^5)/cm^3$ and 600 $(kg^2 \cdot mm^5)/cm^3$.

Table 1 shows the seven embodiments having a specific D1xyz ratio defined as:

$$D1xyz = \frac{(D1 * Ixx * Izz * Iyy)}{\text{Volume}} \quad \text{Eq. 4}$$

The seven embodiments of Table 1 have achieved a D1xyz ratio defined by Eq. 4 that is less than 280,000 $(kg^3 \cdot mm^7)/cm^3$. More specifically, the embodiments of Table 1 have achieved a D1xyz ratio of between 30,000 $(kg^3 \cdot mm^7)/cm^3$ and 280,000 $(kg^3 \cdot mm^7)/cm^3$ or between 35,000 $(kg^3 \cdot mm^7)/cm^3$ and 275,000 $(kg^3 \cdot mm^7)/cm^3$. In some embodiments, the D1xyz ratio is between 35,000 $(kg^3 \cdot mm^7)/cm^3$ and 250,000 $(kg^3 \cdot mm^7)/cm^3$ or between 30,000 $(kg^3 \cdot mm^7)/cm^3$ and 240,000 $(kg^3 \cdot mm^7)/cm^3$. In yet other embodiments, the D1xyz ratio is between 30,000 $(kg^3 \cdot mm^7)/cm^3$ and 230,000 $(kg^3 \cdot mm^7)/cm^3$ or between 30,000 $(kg^3 \cdot mm^7)/cm^3$ and 220,000 $(kg^3 \cdot mm^7)/cm^3$. In yet other embodiments, the D1xyz ratio is between 30,000 $(kg^3 \cdot mm^7)/cm^3$ and 200,000 $(kg^3 \cdot mm^7)/cm^3$ or between 30,000 $(kg^3 \cdot mm^7)/cm^3$ and 150,000 $(kg^3 \cdot mm^7)/cm^3$. In yet other embodiments, the D1xyz ratio is between 30,000 $(kg^3 \cdot mm^7)/cm^3$ and 175,000 $(kg^3 \cdot mm^7)/cm^3$ or between 30,000 $(kg^3 \cdot mm^7)/cm^3$ and 125,000 $(kg^3 \cdot mm^7)/cm^3$.

Table 1 shows the seven embodiments having a specific D1y ratio defined as:

$$D1y = \frac{(D1 * Iyy)}{\text{Volume}} \quad \text{Eq. 5}$$

The seven embodiments of Table 1 have achieved a D1y ratio defined by Eq. 5 that is less than 5.0 $(kg \cdot mm^3)/cm^3$. More specifically, the embodiments of Table 1 have achieved a D1y ratio of between 0.5 $(kg \cdot mm^3)/cm^3$ and 5.0 $(kg \cdot mm^3)/cm^3$ or between 1 $(kg \cdot mm^3)/cm^3$ and 5 $(kg \cdot mm^3)/cm^3$. In some embodiments, the D1y ratio is between 1 $(kg \cdot mm^3)/cm^3$ and 4.9 $(kg \cdot mm^3)/cm^3$ or between 1 $(kg \cdot mm^3)/cm^3$ and 4.8 $(kg \cdot mm^3)/cm^3$. In other embodiments, the D1y ratio is between 1 $(kg \cdot mm^3)/cm^3$ and 4.7 $(kg \cdot mm^3)/cm^3$ or between 1 $(kg \cdot mm^3)/cm^3$ and 4.5 $(kg \cdot mm^3)/cm^3$. In yet other embodiments, the D1y ratio is between 0.5 $(kg \cdot mm^3)/cm^3$ and 4.4 $(kg \cdot mm^3)/cm^3$ or between 0.5 $(kg \cdot mm^3)/cm^3$ and 4 $(kg \cdot mm^3)/cm^3$.

Any charts and tables disclosed herein, which give exact values, are to be interpreted as also disclosing an embodiment where each of the values is ±10% of the value indicated, and in further embodiments each of the values is ±7.5%, ±5%, or ±2.5%, thereby disclosing distinct upper values for each, distinct lower values for each, as well as closed ranges having upper and lower limiting values.

As with all the relationships disclosed herein, these relationships are more than mere optimization, maximization, or minimization of a single characteristic or variable, and are often contrary to conventional design thinking yet have been found to achieve a unique balance of the trade-offs associated with competing criteria such as durability, weight distribution, CG placement, impact dynamics, COR and CT characteristics, and desired moments of inertia. The aforementioned balance requires trade-offs among the competing characteristics recognizing key points of diminishing returns. Therefore, this disclosure contains a unique combination of relationships that produce a low moment of inertia golf club, and reduce the negative attributes associated therewith. Further, the relative dimensions, including, but not limited to component length, width, depth, thickness, cross-sectional dimensions, their placement within the club head, and their relationships to one another and the other design variables disclosed herein, influence the aforementioned criteria. Additionally, many embodiments have identified upper and/or lower limits ranges. For embodiments outside these ranges or relationships, the performance may suffer and adversely impact the goals of the design.

In view of the many possible embodiments to which the principles of the disclosed invention may be applied, it should be recognized that the illustrated embodiments are only preferred examples of the invention and should not be taken as limiting the scope of the invention. It will be evident that various modifications may be made thereto without departing from the broader spirit and scope of the invention as set forth. The specification and drawings are, accordingly, to be regarded in an illustrative sense rather than a restrictive sense.

I claim:

1. A golf club head comprising:

a heel portion, a sole portion, a toe portion, a crown portion, a front portion, a rear portion, a hosel defining a club head shaft axis ("hosel axis"), a club head volume ("volume") and a striking face;

the front portion having an upper front portion and a lower front portion;

the upper front portion made of a first material and the lower front portion made of a material different from the upper front portion;

an aft body having at least a portion of the crown portion and a portion of the sole portion, the aft body being made of a non-metallic and metallic material;

a golf club head origin positioned at a geometric center of the striking face, the head origin at least partially defining a club head origin coordinate system, including three axes:

a z-axis extending through the head origin in a generally vertical direction relative to a ground plane when the club head is at a normal address position;

an x-axis extending through the head origin in a toe-to-heel direction generally parallel to the striking face and generally perpendicular to the z-axis; and a y-axis extending through the head origin in a front-to-rear direction and generally perpendicular to the x-axis and to the z-axis;

a golf club head center of gravity (CG) positioned at a distance ("Delta1" or "D1") rearward of the hosel axis, as measured along the y-axis, the CG forming a second origin, of a CG coordinate system including three axes:

a CG z-axis extending through the CG in a generally vertical direction relative to the ground plane when the club head is at the normal address position;

a CG x-axis extending through the CG in a toe-to-heel direction generally parallel to the striking face, and generally perpendicular to the CG z-axis; and a CG y-axis extending through the CG in a front-to-rear direction and generally perpendicular to the CG x-axis and to the CG z-axis;

a moment of inertia, including:

a moment of inertia about the CG z-axis ("Izz");

a moment of inertia about the CG z-axis ("Ixx"); and a moment of inertia about the CG y-axis ("Iyy");

a Dz ratio ("D1z"), wherein D1z is defined by the following formula:

$$D1z=(D1*Izz)/\text{volume};$$

wherein D1z is between 0.5 $(kg\cdot mm^3)/cm^3$ and 6.2 $(kg\cdot mm^3)/cm^3$;

a dimension Delta 3 ("Delta3") measured along the hosel axis, wherein Delta3 is defined as a distance between the CG and a plane extending perpendicular to the hosel axis, the plane located at a top edge of the hosel; wherein Delta3 is between 65 mm and 80 mm;

a balance point ("BP") that is defined as a location where an imaginary line passing through the CG and oriented normal to the striking face intersects the striking face; and a BP Proj. Up, defined as a distance of BP above or below the head origin;

wherein BP Proj. Up is between 15 mm and 30 mm; and wherein the volume is between approximately 50 $cm^3$ and approximately 460 $cm^3$.

2. The golf club head according to claim 1, wherein the golf club head center of gravity (CG) has a head origin x-axis coordinate CGX of between 0 mm and 4 mm.

3. The golf club head according to claim 1, wherein the golf club head center of gravity (CG) has a head origin z-axis coordinate CGZ of between 0 mm and −11 mm.

4. The golf club head according to claim 1, wherein the golf club head center of gravity (CG) has a head origin y-axis coordinate CGY of between 15 mm and 23 mm.

5. The golf club head according to claim 1, wherein Delta1 is between 1 mm and 10 mm.

6. The golf club head according to claim 1, further comprising a Delta 2 point ("D2 Point"), wherein the D2 Point is defined by projecting the center of gravity (CG) forward along the CG y-axis until it strikes a point defined on an imaginary vertical shaft axis plane containing the hosel axis;

wherein a Delta 2 measurement ("Delta2") is defined as the shortest distance from the D2 Point to the hosel axis; and wherein Delta2 is between 25 mm and 35 mm.

7. The golf club head according to claim 1, further comprising a dimension CFY, measured along the head origin y-axis, defined as a distance from the club head origin to a vertical plane containing the hosel axis;

wherein CFY is between 12 mm and 17 mm.

8. The golf club head according to claim 1, wherein the golf club head has a mass between 190 g and 215 g.

9. The golf club head according to claim 1, wherein Ixx is between 100 $kg\cdot mm^2$ and 200 $kg\cdot mm^2$.

10. The golf club head according to claim 1, wherein Iyy is between 200 $kg\cdot mm^2$ and 275 $kg\cdot mm^2$.

11. The golf club head according to claim 1, wherein Izz is between 230 $kg\cdot mm^2$ and 320 $kg\cdot mm^2$.

12. The golf club head according to claim 1, wherein the CG z-axis has a measurement Zup defined as a height of the CG above the ground plane when the club head is at the normal address position; and wherein Zup is between 10 mm and 25 mm.

13. The golf club head according to claim 1, wherein the golf club head has a volume divided by Delta1 of between 50 cc/mm to 230 cc/mm.

14. The golf club head according to claim 1, wherein the CG z-axis has a measurement Zup defined as a height of the CG above the ground plane when the club head is at the normal address position; and wherein the golf club head has a volume divided by Zup ratio of between 10 cc/mm and 30 cc/mm.

15. The golf club head according to claim 1, wherein the CG z-axis has a measurement Zup defined as a height of the CG above the ground plane when the club head is at the normal address position; and wherein the golf club head has a Zup divided by D1 ratio of between 2 to 15.

16. The golf club head according to claim 1, wherein the CG z-axis has a measurement Zup defined as a height of the CG above the ground plane when the club head is at the normal address position; and wherein the golf club head has a volume divided by Zup divided by D1 ratio of between 20 cc and 170 cc.

17. A golf club head comprising:

a heel portion, a sole portion, a toe portion, a crown portion, a front portion, a rear portion, a hosel defining a club head shaft axis ("hosel axis"), a club head volume ("volume"), and a striking face;

the front portion having an upper front portion and a lower front portion;

the upper front portion made of a first material and the lower front portion made of a material different from the upper front portion;

an aft body having at least a portion of the crown portion and a portion of the sole portion, the aft body being made of a non-metallic and metallic material;

a golf club head origin positioned at a geometric center of the striking face, the head origin at least partially defining a club head origin coordinate system, including three axes:

a z-axis extending through the head origin in a generally vertical direction relative to a ground plane when the club head is at a normal address position;

an x-axis extending through the head origin in a toe-to-heel direction generally parallel to the striking face and generally perpendicular to the z-axis; and a y-axis extending through the head origin in a front-to-rear direction and generally perpendicular to the x-axis and to the z-axis;

a golf club head center of gravity (CG) positioned at a distance ("Delta1" or "D1") rearward of the hosel axis, as measured along the y-axis, the CG forming a second origin, of a CG coordinate system including three axes:

a CG z-axis extending through the CG in a generally vertical direction relative to the ground plane when the club head is at the normal address position;

a CG x-axis extending through the CG in a toe-to-heel direction generally parallel to the striking face, and generally perpendicular to the CG z-axis; and a CG y-axis extending through the CG in a front-to-rear direction and generally perpendicular to the CG x-axis and to the CG z-axis;

a moment of inertia, including:

a moment of inertia about the CG z-axis ("Izz");

a moment of inertia about the CG z-axis ("Ixx"); and a moment of inertia about the CG y-axis ("Iyy");

a D1y ratio ("D1y"), wherein D1y is defined by the following formula:

$$D1y=(D1*Iyy)/\text{volume};$$

wherein D1y is between 0.5 $(kg\cdot mm^3)/cm^3$ and 5.0 $(kg\cdot mm^3)/cm^3$;

a dimension Delta 3 ("Delta3") measured along the hosel axis, wherein Delta3 is defined as a distance between the CG and a plane extending perpendicular to the hosel axis, the plane located at a top edge of the hosel; wherein Delta3 is between 65 mm and 80 mm;

a balance point ("BP") that is defined as a location where an imaginary line passing through the CG and oriented normal to the striking face intersects the striking face; and a BP Proj. Up, defined as a distance of BP above or below the head origin;

wherein BP Proj. Up is between 15 mm and 30 mm; and wherein the volume is between approximately 50 $cm^3$ and approximately 460 $cm^3$.

18. A golf club head comprising:

a heel portion, a sole portion, a toe portion, a crown portion, a front portion, a rear portion, a hosel defining a club head shaft axis ("hosel axis"), a club head volume ("volume"), and a striking face;

the front portion having an upper front portion and a lower front portion;

the upper front portion made of a first material and the lower front portion made of a material different from the upper front portion;

an aft body having at least a portion of the crown portion and a portion of the sole portion, the aft body being made of a non-metallic and metallic material;

a golf club head origin positioned at a geometric center of the striking face, the head origin at least partially defining a club head origin coordinate system, including three axes:

a z-axis extending through the head origin in a generally vertical direction relative to a ground plane when the club head is at a normal address position;

an x-axis extending through the head origin in a toe-to-heel direction generally parallel to the striking face and generally perpendicular to the z-axis; and a y-axis extending through the head origin in a front-to-rear direction and generally perpendicular to the x-axis and to the z-axis;

a golf club head center of gravity (CG) positioned at a distance ("Delta1" or "D1") rearward of the hosel axis, as measured along the y-axis, the CG forming a second origin, of a CG coordinate system including three axes:

a CG z-axis extending through the CG in a generally vertical direction relative to the ground plane when the club head is at the normal address position;

a CG x-axis extending through the CG in a toe-to-heel direction generally parallel to the striking face, and generally perpendicular to the CG z-axis; and a CG y-axis extending through the CG in a front-to-rear direction and generally perpendicular to the CG x-axis and to the CG z-axis;

a moment of inertia, including:

a moment of inertia about the CG z-axis ("Izz");

a moment of inertia about the CG z-axis ("Ixx"); and a moment of inertia about the CG y-axis ("Iyy");

a D1x ratio ("D1x"), wherein D1x is defined by the following formula:

$$D1x=(D1*Ixx)/\text{volume};$$

wherein D1x is between 0.3 $(kg\cdot mm^3)/cm^3$ and 3.9 $(kg\cdot mm^3)/cm^3$;

a dimension Delta 3 ("Delta3") measured along the hosel axis, wherein Delta3 is defined as a distance between the CG and a plane extending perpendicular to the hosel axis, the plane located at a top edge of the hosel; wherein Delta3 is between 65 mm and 80 mm;

a balance point ("BP") that is defined as a location where an imaginary line passing through the CG and oriented normal to the striking face intersects the striking face; and a BP Proj. Up, defined as a distance of BP above or below the head origin;

wherein BP Proj. Up is between 15 mm and 30 mm; and wherein the volume is between approximately 50 $cm^3$ and approximately 460 $cm^3$.

19. A golf club head comprising:

a heel portion, a sole portion, a toe portion, a crown portion, a front portion, a rear portion, a hosel defining a club head shaft axis ("hosel axis"), a club head volume ("volume"), and a striking face;

the front portion having an upper front portion and a lower front portion;

the upper front portion made of a first material and the lower front portion made of a material different from the upper front portion;

an aft body having at least a portion of the crown portion and a portion of the sole portion, the aft body being made of a non-metallic and metallic material;

a golf club head origin positioned at a geometric center of the striking face, the head origin at least partially defining a club head origin coordinate system, including three axes:

a z-axis extending through the head origin in a generally vertical direction relative to a ground plane when the club head is at a normal address position;

an x-axis extending through the head origin in a toe-to-heel direction generally parallel to the striking face and generally perpendicular to the z-axis; and a y-axis extending through the head origin in a front-to-rear direction and generally perpendicular to the x-axis and to the z-axis;

a golf club head center of gravity (CG) positioned at a distance ("Delta1" or "D1") rearward of the hosel axis, as measured along the y-axis, the CG forming a second origin, of a CG coordinate system including three axes:

a CG z-axis extending through the CG in a generally vertical direction relative to the ground plane when the club head is at the normal address position;

a CG x-axis extending through the CG in a toe-to-heel direction generally parallel to the striking face, and generally perpendicular to the CG z-axis; and a CG y-axis extending through the CG in a front-to-rear direction and generally perpendicular to the CG x-axis and to the CG z-axis;

a moment of inertia, including:

a moment of inertia about the CG z-axis ("Izz");

a moment of inertia about the CG z-axis ("Ixx"); and a moment of inertia about the CG y-axis ("Iyy"); and a D1xz ratio ("D1xz"), wherein D1xz is defined by the following formula:

$$D1xz=(D1*Ixx*Izz)/\text{volume};$$

wherein D1xz is between 100 $(kg^2 \cdot mm^5)/cm^3$ and 1300 $(kg^2 \cdot mm^5)/cm^3$;

a dimension Delta 3 ("Delta3") measured along the hosel axis, wherein Delta3 is defined as a distance between the CG and a plane extending perpendicular to the hosel axis, the plane located at a top edge of the hosel; wherein Delta3 is between 65 mm and 80 mm;

a balance point ("BP") that is defined as a location where an imaginary line passing through the CG and oriented normal to the striking face intersects the striking face; and a BP Proj. Up, defined as a distance of BP above or below the head origin;

wherein BP Proj. Up is between 15 mm and 30 mm; and wherein the volume is between approximately 50 $cm^3$ and approximately 460 $cm^3$.

20. A golf club head comprising:

a heel portion, a sole portion, a toe portion, a crown portion, a front portion, a rear portion, a hosel defining a club head shaft axis ("hosel axis"), a club head volume ("volume"), and a striking face;

the front portion having an upper front portion and a lower front portion;

the upper front portion made of a first material and the lower front portion made of a material different from the upper front portion;

an aft body having at least a portion of the crown portion and a portion of the sole portion, the aft body being made of a non-metallic and metallic material;

a golf club head origin positioned at a geometric center of the striking face, the head origin at least partially defining a club head origin coordinate system, including three axes:

a z-axis extending through the head origin in a generally vertical direction relative to a ground plane when the club head is at a normal address position;

an x-axis extending through the head origin in a toe-to-heel direction generally parallel to the striking face and generally perpendicular to the z-axis; and a y-axis extending through the head origin in a front-to-rear direction and generally perpendicular to the x-axis and to the z-axis;

a golf club head center of gravity (CG) positioned at a distance ("Delta1" or "D1") rearward of the hosel axis, as measured along the y-axis, the CG forming a second origin, of a CG coordinate system including three axes:

a CG z-axis extending through the CG in a generally vertical direction relative to the ground plane when the club head is at the normal address position;

a CG x-axis extending through the CG in a toe-to-heel direction generally parallel to the striking face, and generally perpendicular to the CG z-axis; and a CG y-axis extending through the CG in a front-to-rear direction and generally perpendicular to the CG x-axis and to the CG z-axis;

a moment of inertia, including:

a moment of inertia about the CG z-axis ("Izz");

a moment of inertia about the CG z-axis ("Ixx"); and a moment of inertia about the CG y-axis ("Iyy"); and a D1xyz ratio ("D1xyz"), wherein D1xyz is defined by the following formula:

$$D1xyz=(D1*Ixx*Iyy*Izz)/\text{volume};$$

wherein D1xyz is between 30,000 $(kg^3 \cdot mm^7)/cm^3$ and 280,000 $(kg^3 \cdot mm^7)/cm^3$;

a dimension Delta 3 ("Delta3") measured along the hosel axis, wherein Delta3 is defined as a distance between the CG and a plane extending perpendicular to the hosel axis, the plane located at a top edge of the hosel; wherein Delta3 is between 65 mm and 80 mm;

a balance point ("BP") that is defined as a location where an imaginary line passing through the CG and oriented normal to the striking face intersects the striking face; and a BP Proj. Up, defined as a distance of BP above or below the head origin;

wherein BP Proj. Up is between 15 mm and 30 mm; and wherein the volume is between approximately 50 $cm^3$ and approximately 460 $cm^3$.

* * * * *